US008926210B2

(12) United States Patent
Orubor

(10) Patent No.: US 8,926,210 B2
(45) Date of Patent: Jan. 6, 2015

(54) GLASS AND WINDOW CLEANING APPARATUS

(76) Inventor: Lawrence Orubor, Calgary (CA)

( * ) Notice: Subject to any disclaimer, the term of this patent is extended or adjusted under 35 U.S.C. 154(b) by 823 days.

(21) Appl. No.: 13/016,457

(22) Filed: Jan. 28, 2011

(65) Prior Publication Data

US 2011/0185533 A1 Aug. 4, 2011

Related U.S. Application Data

(60) Provisional application No. 61/301,267, filed on Feb. 4, 2010.

(51) Int. Cl.
*A47L 1/08* (2006.01)
*A47L 1/00* (2006.01)
*A47L 1/05* (2006.01)

(52) U.S. Cl.
CPC ... *A47L 1/00* (2013.01); *A47L 1/05* (2013.01); *A47L 1/08* (2013.01)
USPC ..... 401/188 R; 401/138; 401/139; 401/25; 401/37; 16/427

(58) Field of Classification Search
CPC ..... A47L 1/05; A47L 1/06; A47L 1/08; A47L 1/15; A47L 13/11; B05C 17/005; B05C 17/00569; A45D 2200/056; A45D 2200/057; B25F 5/00; B25F 5/02; B25F 5/024; B25F 5/026
USPC ..... 401/188 R, 137, 138, 139, 261, 263, 16, 401/25, 37; 16/426, 427, 429
See application file for complete search history.

(56) References Cited

U.S. PATENT DOCUMENTS

| | | | | |
|---|---|---|---|---|
| 4,776,716 | A | 10/1988 | Huang | |
| 5,165,811 | A | 11/1992 | MacLeod | |
| 5,316,401 | A | 5/1994 | Sears | |
| 5,363,528 | A | 11/1994 | Brock | |
| 5,364,198 | A | 11/1994 | Skenderi | |
| 5,735,620 | A | 4/1998 | Ford | |
| 6,112,367 | A * | 9/2000 | Burr et al. | 15/401 |
| 6,141,814 | A | 11/2000 | Renken | |
| 6,199,240 | B1 | 3/2001 | You | |
| 6,378,159 | B1 | 4/2002 | Garrison et al. | |
| 6,681,439 | B1 | 1/2004 | Kohlruss et al. | |
| 6,692,171 | B2 | 2/2004 | Vito | |

(Continued)

*Primary Examiner* — David Walczak
(74) *Attorney, Agent, or Firm* — Maxey Law Offices, PLLC; Stephen Lewellyn

(57) ABSTRACT

A window and glass cleaning device includes a cleaning head and an elongated handle configured to be grasped by a user. The handle has a first end connected to the cleaning head and a second end configured to be connected to an extension handle. A fluid container is housed by the handle, and a spray nozzle is carried by said handle at a position approximate the first end of the handle. A pump is carried by the handle and connects the fluid container to the spray nozzle. The pump includes a pump actuator. An electric motor is carried by the handle and is operatively connected to pump actuator to drive the pump actuator in the pumping of fluid from the container through the spray nozzle. A power source and an electric switch are carried by the handle. The electrical switch is operatively connected to the power source and to the electric motor and is operable by the user to connect the power source to the electric motor to facilitate the pumping of said fluid through said spray nozzle.

14 Claims, 21 Drawing Sheets

(56) References Cited

U.S. PATENT DOCUMENTS

| | | | | |
|---|---|---|---|---|
| 6,742,951 | B2 | 6/2004 | Schultz et al. | |
| 6,931,690 | B2 | 8/2005 | Cox | |
| 6,948,873 | B2 | 9/2005 | Policicchio et al. | |
| 7,000,282 | B2 | 2/2006 | Cox et al. | |
| 7,430,781 | B2 | 10/2008 | Collins | |
| 7,470,078 | B2 | 12/2008 | Banco et al. | |
| 7,552,806 | B2 * | 6/2009 | Tong | 191/12 R |
| 8,167,510 | B2 * | 5/2012 | LaFlamme et al. | 401/188 R |
| 8,360,668 | B1 * | 1/2013 | Hinnant | 401/188 R |
| 2002/0078519 | A1 | 6/2002 | Boothby | |
| 2003/0208873 | A1 | 11/2003 | Chang | |
| 2005/0095053 | A1 | 5/2005 | Harris | |
| 2005/0283931 | A1 | 12/2005 | Endo et al. | |
| 2006/0228161 | A1 | 10/2006 | Hoadley et al. | |
| 2006/0233592 | A1 | 10/2006 | Knopow et al. | |
| 2006/0260084 | A1 | 11/2006 | Guizzi | |
| 2007/0044264 | A1 | 3/2007 | Argo et al. | |
| 2008/0115302 | A1 | 5/2008 | Kilkenny et al. | |
| 2008/0199245 | A1 | 8/2008 | Bruggeman | |
| 2008/0250590 | A1 | 10/2008 | Trefethren et al. | |
| 2009/0049636 | A1 | 2/2009 | Bae | |
| 2009/0097907 | A1 | 4/2009 | Blom et al. | |

* cited by examiner

GLASS AND WINDOW CLEANING APPARATUS

CROSS-REFERENCE TO RELATED APPLICATIONS

This application claims the benefit of U.S. Provisional Application No. 61/301,267, filed Feb. 4, 2010, the entire of which is incorporated herein by reference.

FIELD OF THE INVENTION

The present invention relates generally to cleaning implements, and more particularly, relating to a window and glass cleaning apparatus including the automated dispensing of a cleaning fluid and including several embodiments of cleaning heads having multiple cleaning implement arrangements, and including several accessory attachments.

BACKGROUND OF THE INVENTION

Cleaning windows and glass can be a time consuming and laborious choir. There exists numerous cleaning devices and squeegee blades of a myriad of constructions directed towards reducing the effort and time required to clean windows and glass. However, there remains a need for a window and glass cleaning apparatus of an improved construct which overcomes the drawbacks of the existing cleaning devices.

SUMMARY OF THE INVENTION

The preferred embodiments of the present invention addresses this need by providing a window and glass cleaning apparatus of an improved construction and including the automated dispensing of a cleaning fluid, several cleaning head configurations, and accessory attachments.

In general, in one aspect, the window and glass cleaning device includes a cleaning head and an elongated handle configured to be grasped by a user. The handle has a first end connected to the cleaning head and a second end configured to be connected to an extension handle. A fluid container is housed by the handle, and a spray nozzle is carried by said handle at a position approximate the first end of the handle. A pump is carried by the handle and connects the fluid container to the spray nozzle. The pump includes a pump actuator. An electric motor is carried by the handle and is operatively connected to pump actuator to drive the pump actuator in the pumping of fluid from the container through the spray nozzle. A power source and an electric switch are carried by the handle. The electrical switch is operatively connected to the power source and to the electric motor and is operable by the user to connect the power source to the electric motor to facilitate the pumping of said fluid through said spray nozzle.

In general, in another aspect, the cleaning head includes a cleaning implement and a squeegee blade positioned on opposite sides of said cleaning head.

In general, in another aspect, the cleaning head is pivotally connected to said first end of said handle.

In general, in another aspect, the container is removable received by said handle.

In general, in another aspect, the container is integral with said handle.

In general, in another aspect, an extension handle is connected to the handle at the second end thereof. A secondary electric switch is carried by the extension handle and is operatively connected to the power source and the electric motor and is operable by the user to connect the power source to the electric motor to facilitate the pumping of the fluid through the spray nozzle.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
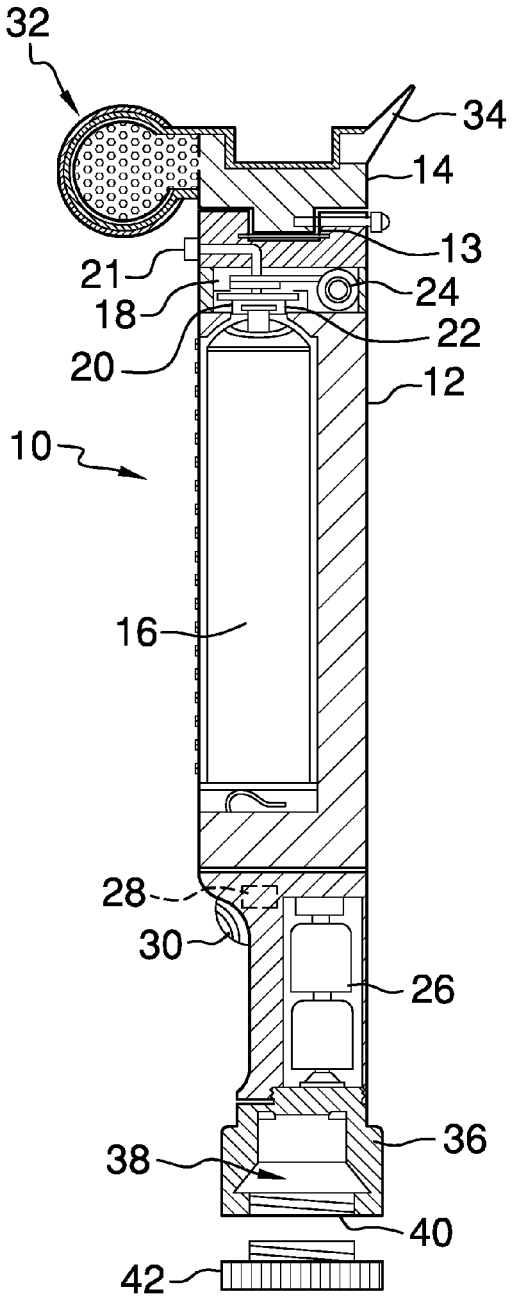
FIG. 1 is a diagrammatic partial side cross sectional view of a glass and window cleaning apparatus constructed in accordance with the principles of the present invention.
Figure 12:
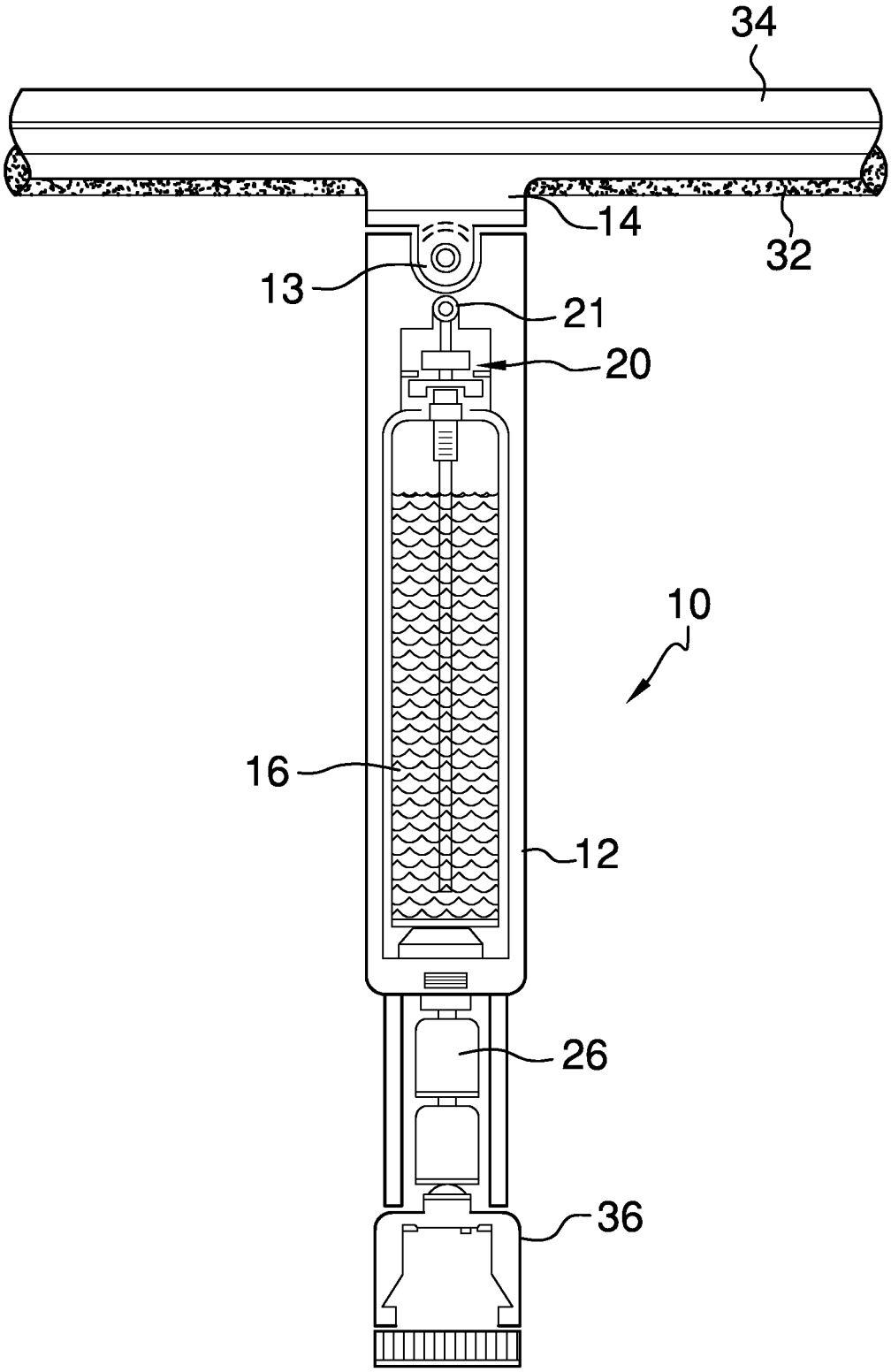
FIG. 12 is a diagrammatic partial front cross sectional view of the apparatus of FIG. 1 illustrating the cleaning head positioned in the in-use position where the cleaning head forms a general T-shape with the handle.
Figure 13:
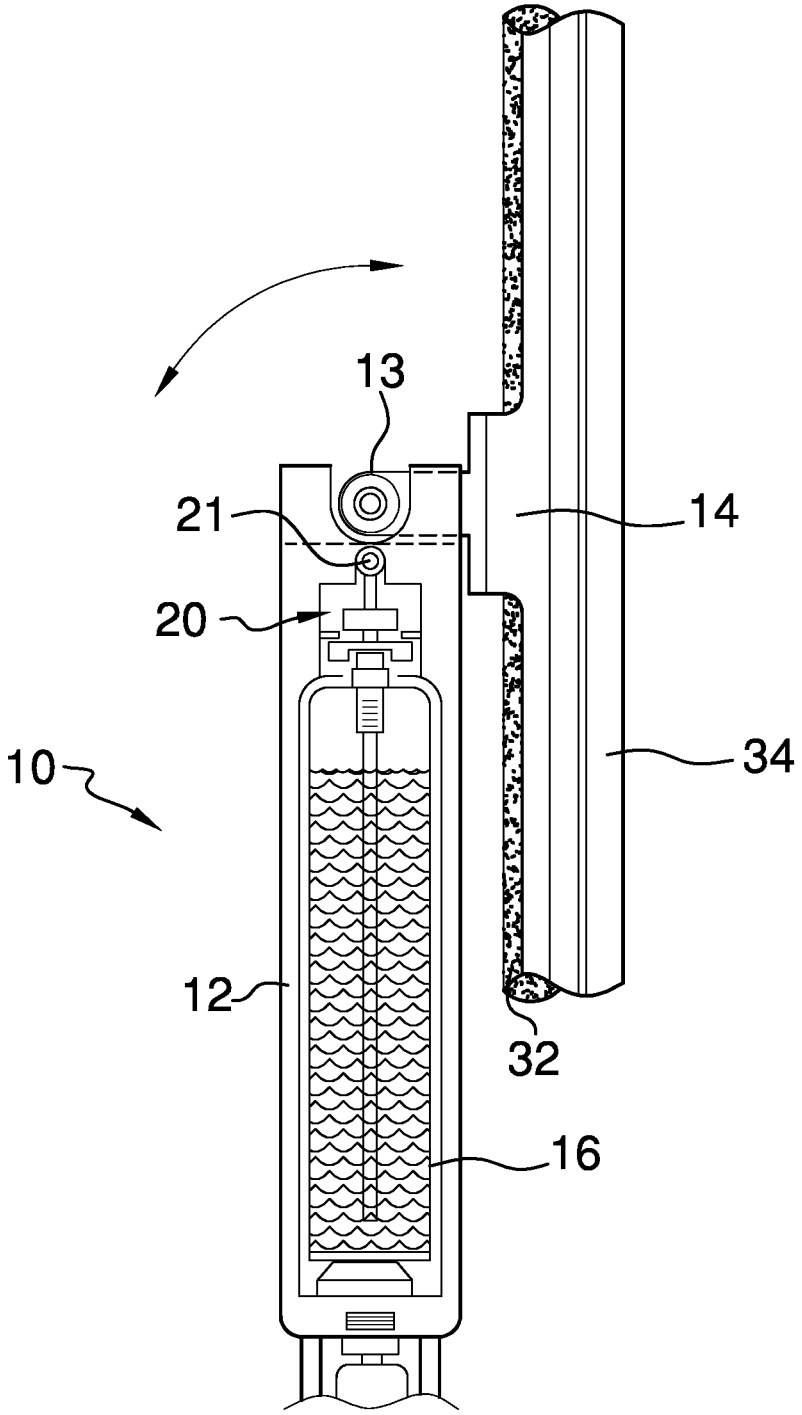
FIG. 13 is a diagrammatic partial front cross sectional view of the apparatus of FIG. 1 illustrating the cleaning head positioned in the storage position where the cleaning head is positioned generally parallel to the handle.

Reference will now be made in detail to the preferred embodiments of the present invention, examples of which are illustrated in the accompanying drawings. FIG. 1 is a diagrammatic partial side cross sectional view of the window and glass cleaning apparatus 10 of the invention. The apparatus 10 includes an elongated handle 12 and an elongated cleaning head 14. The cleaning head 14 is pivotally connected to one end of the handle 12 by pivot coupling 13 for rotation about an axis generally normal to a longitudinal axis of the handle 12. The cleaning head 14 rotates with respective to the handle 12 between an in use position where the cleaning head and handle form a T-shape, as best seen in FIG. 12, and where the cleaning head is positioned along side and generally parallel to the handle, as best seen in FIG. 13.

The handle 12 houses a container 16 for holding a cleaning fluid to be dispensed during operation of the apparatus. The container 16 can be integrally formed with the handle 12 or alternatively, the container can be removably positioned within the handle, as shown. The handle 12 further comprises a pump chamber 18 in which is positioned a pump 20 for dispensing or pumping out the cleaning fluid held within container 16. The pump 20 connects the container 16 to a spray nozzle 21 through which the cleaning fluid held within the container is dispensed from during operation of the pump. The spray nozzle 21 is positioned below the cleaning head 14. As will be discussed further below, the container 16 may hold the cleaning fluid under pressure, such as an aerosol. Alternatively, the container 16 may hold the cleaning fluid under atmospheric pressure. In either instances, the container 16 and the pump 20 are configured for cooperation and the pump is operated to dispense the cleaning fluid held within the container 16 from the container and through the spray nozzle 21 for application to a surface to be cleaned.

While it is possible for the pump 20 to be a manually operated pump, it is preferred that the pump be electrically operated for user convenience. In which case, the pump 20 includes a pump actuator 22 that mechanically drives the pump. An electric motor 24 operatively engages the pump actuator 22 for operation thereof to dispense the cleaning fluid held within the container 16. The motor 24 is electrically connected to a power source, such as batteries 26 held within the handle 12. A switch 28 electrically connects the motor 24 and the power source 26 for selectively supplying power to the motor. A trigger assembly 30 may be included and mounted to the handle 12. The trigger assembly 30 operatively engages the switch 28 for selective operation thereof.

The cleaning head 14 includes a cleaning implement 32 and a squeegee blade 34. As depicted in FIG. 1, the cleaning implement 32 and the squeegee blade 34 are positioned on opposite longitudinal sides of the cleaning head 14, and extend the longitudinal length of the cleaning head.

With continued reference to FIG. 1, end portion 36 is removably attached to the handle 12, for example through a cooperative threaded engagement, to permit access to power supply or batteries 26 for replacement. End portion 36 permits the attachment of accessories to the handle 12 and includes a female receiving space 38 that is cooperatively engagable to an accessory permitting the connection to handle. Access to the female receiving space 38 is made through opening 40 formed through an end of the end portion 36. Opening 40 is selectively closed by a cap 42 that is threadable into the opening 40.

Figure 2:
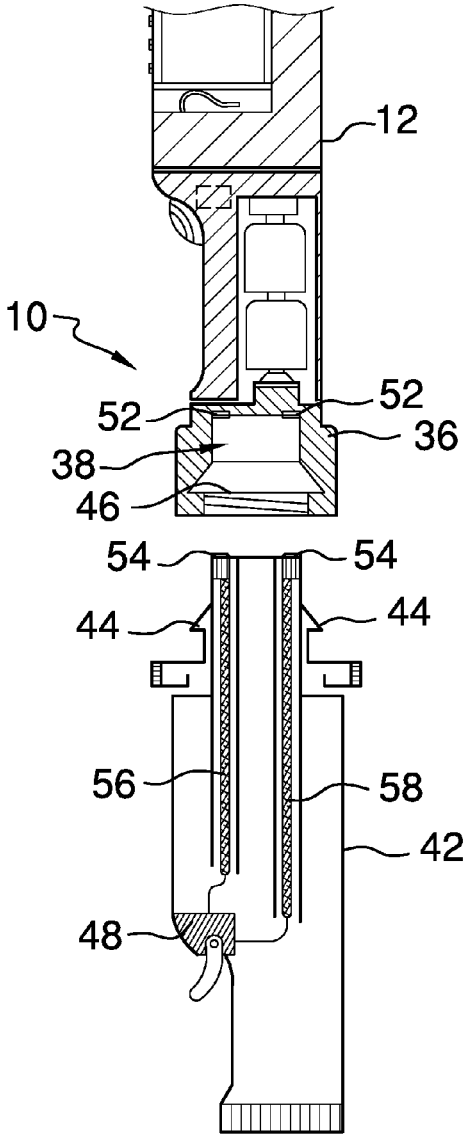
FIG. 2 is a diagrammatic partial side cross sectional view of the apparatus of FIG. 1 illustrating an accessory in the form of an extension handle.

FIG. 2 is a diagrammatic partial side cross sectional view of the apparatus 10 of FIG. 1 illustrating an accessory in the form of an extension handle 42. The extension handle 42 is shown exploded from handle 12. As shown, cap 42 is removed thereby permitting access to the female receiving space 38 of end portion 36. An end of the extension handle 42 and the female receiving space 38 are configured for cooperative engagement to permit fixedly connecting the extension handle to handle 12. In an aspect, the extension handle 42 can include spring biased tabs 44 that are cooperatively engagable with shoulder 46 of the female receiving space 38. In this instance, the end of the extension handle 42 is inserted through opening 40 and into the female receiving space 38 which causes tabs 44 to be pressed inwardly towards the extension handle. Once the extension handle 42 is fully inserted into the female receiving space 38 of the end portion 36, the tabs 44 engage shoulder 46 and lock the end of the extension handle within the female receiving space, and thereby connect the extension handle to the handle 12. Other structures capable of fixedly connecting the extension handle 42 or accessories to handle 12 could also be employed.

The extension handle 42 includes a secondary electrical switch 48 that is electrically connected to the power source 26 and the motor 24 by a cooperative electrical connection that is made when the extension handle 42 is connected to handle 12. The cooperative electrical connection includes a pair of electrical contacts each including an electrical contact pad 52 positioned within the female receiving space 38 and an electrical contact pad 54 positioned on the extension handle 42. Contact pads 52 and 54 of each electrical connection are arranged such that they are engaged and communicate electrical power when the extension handle 42 is connected to handle 12. The secondary electrical switch 48 is connected to contact pads 54 of each of the electrical connection by associated wiring 56 and 58. Likewise, contact pads 52 of each of the electrical connection are connected to the power supply 26 and the motor 24 by associated wiring (not shown).

Figure 3A:
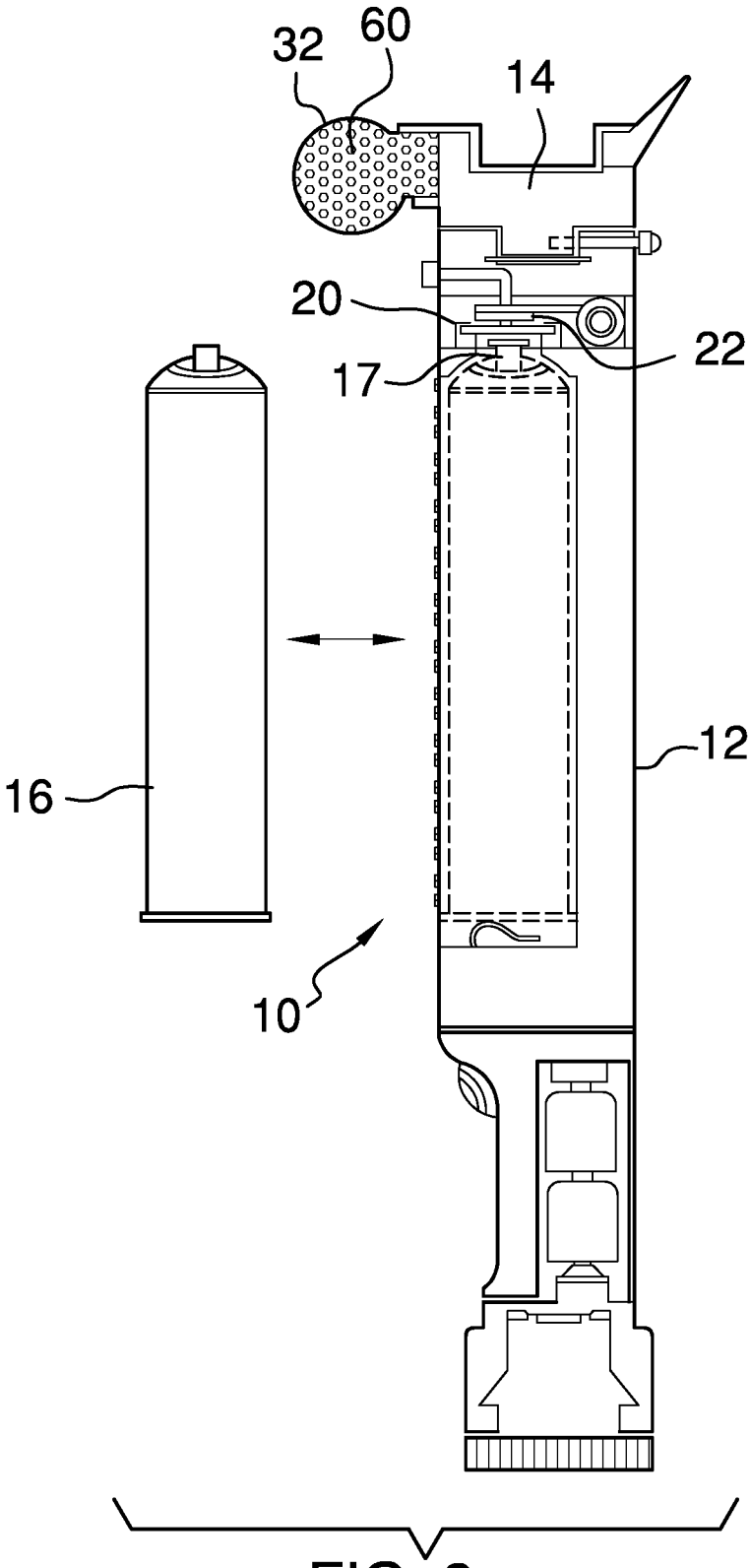
FIG. 3*a* is a diagrammatic partial side cross sectional view of the apparatus of FIG. 1 illustrating the container removed from the handle through a front reception through the handle.

FIG. 3*a* is a diagrammatic partial side cross sectional view of the apparatus 10 of FIG. 1 illustrating the container 16 removed from the handle 12 through a front reception through the handle. Here, the container 16 is shown as an aerosol type container holding the cleaning fluid under pressure. The pump 20 and the pump actuator 22 are configured for cooperative engagement with the nozzle 17 of the container 16 to connect the container to the spray nozzle 21 and to operate nozzle 17 to dispense the cleaning fluid from the container and through the spray nozzle. There exist numerous suitable configurations of the pump actuator 22 in the art that one of ordinary skill would be readily able to select one of the many available pump actuator configurations for implementation herein. Further shown is the cleaning implement 32 having a base 60 of a flexible sponge or absorbent of a conventional type and with a replaceable covering removed therefrom.

Figure 3B:
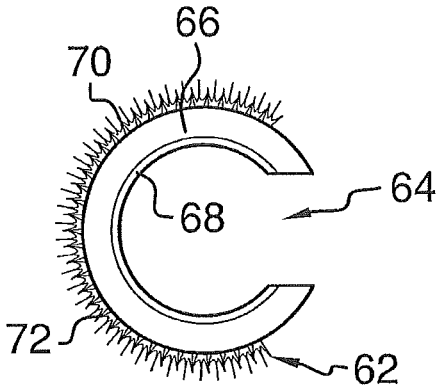
FIG. 3*b* illustrates side view of a first replaceable covering for attachment to the base of the cleaning implement of the apparatus of FIG. 1.

FIG. 3*b* illustrates side view of a first replaceable covering 62 for attachment to the base 60. The covering 62 is a general C-shaped configuration wherein the covering is attached to the base 60 by inserting the base within the opening 64 of the covering such that the covering at least partially wraps around the base. The covering 62 includes an absorbent central layer 66, a water proof backing layer 68 and a scrubbing layer 70 consisting of brush bristles 72 extending continuously around the central layer. The water proof backing layer 68 prevents soiling of the base 60.

Figure 3C:
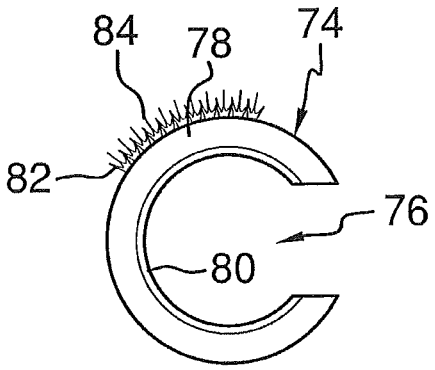
FIG. 3*c* illustrates side view of a second replaceable covering for attachment to the base of the cleaning implement of the apparatus of FIG. 1.

FIG. 3*c* illustrates side view of a second replaceable covering 74 for attachment to the base 60. The covering 74 is a general C-shaped configuration wherein the covering is attached to the base 60 by inserting the base within the opening 76 of the covering such that the covering at least partially wraps around the base. The covering 76 includes an absorbent central layer 78, a water proof backing layer 80 and a scrubbing layer 82 consisting of brush bristles 84 that partially extend around the central layer. The water proof backing layer 80 prevents soiling of the base 60.

Figure 3D:
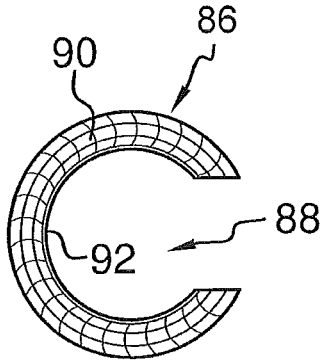
FIG. 3*d* illustrates side view of a third replaceable covering for attachment to the base of the cleaning implement of the apparatus of FIG. 1.

FIG. 3*d* illustrates side view of a third replaceable covering 86 for attachment to the base 60. The covering 86 is a general C-shaped configuration wherein the covering is attached to the base 60 by inserting the base within the opening 88 of the covering such that the covering at least partially wraps around the base. The covering 88 includes an absorbent central layer 90 and a water proof backing layer 92. The water proof backing layer 92 prevents soiling of the base 60.

Figure 4:
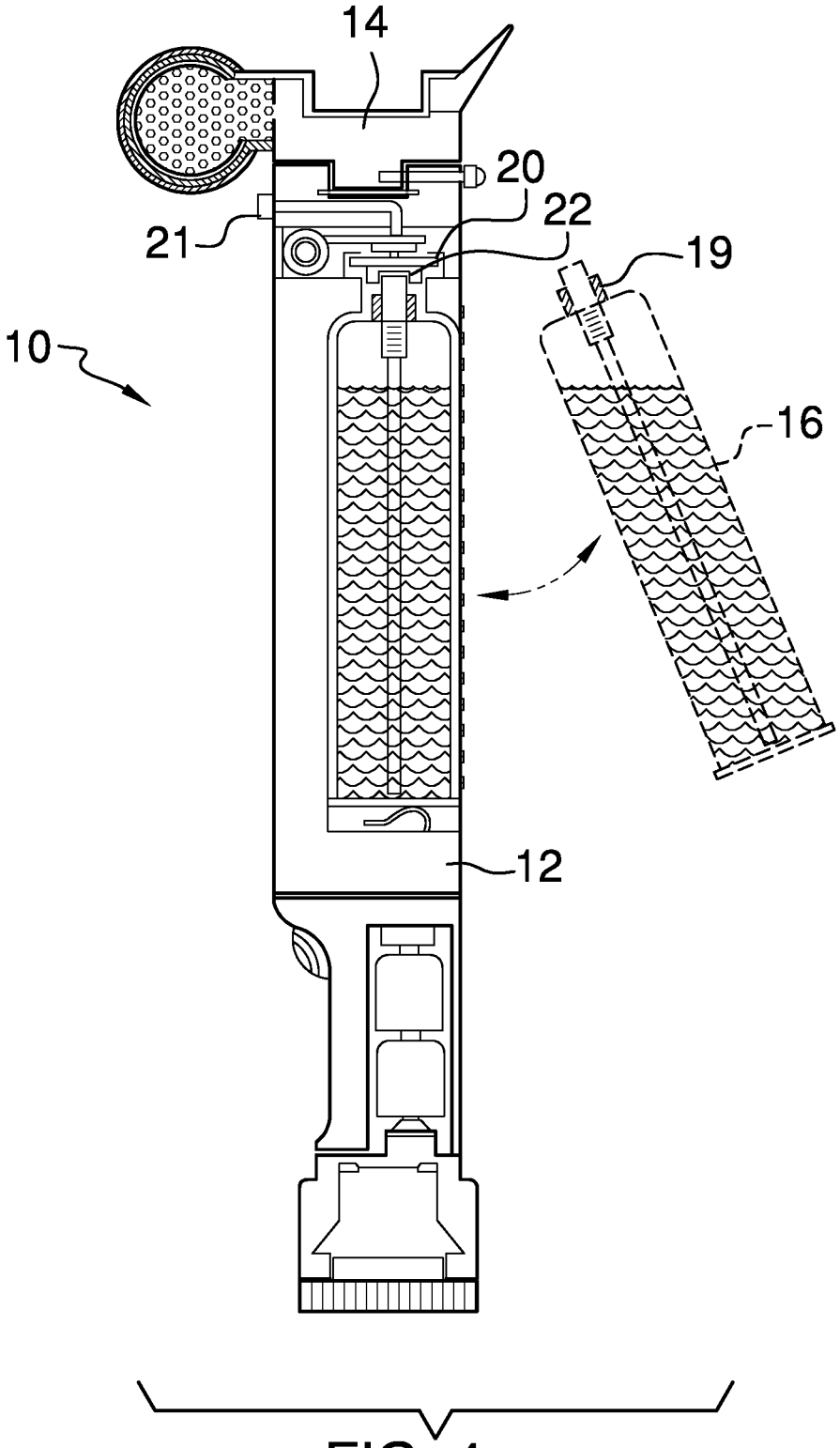
FIG. 4 is a diagrammatic partial side cross sectional view of the apparatus of FIG. 1 illustrating the container removed from the handle through a rear reception through the handle.

FIG. 4 is a diagrammatic partial side cross sectional view of the apparatus 10 of FIG. 1 illustrating the container 16 removed from the handle 12 through a rear reception through the handle. Here, the container 16 is shown as pump container holding the cleaning fluid under atmospheric pressure. The pump and the pump actuator 22 are configured for cooperative engagement with the conventional pump mechanism 19 of the container 16 to connect the container to the spray nozzle 21 and to operate the pump mechanism 19 to dispense the cleaning fluid from the container and through the spray nozzle. There exists numerous suitable configurations of the pump actuator 22 in the art that one of ordinary skill would be readily able to select one of the many available pump actuator configurations for implementation herein.

Figure 5A:
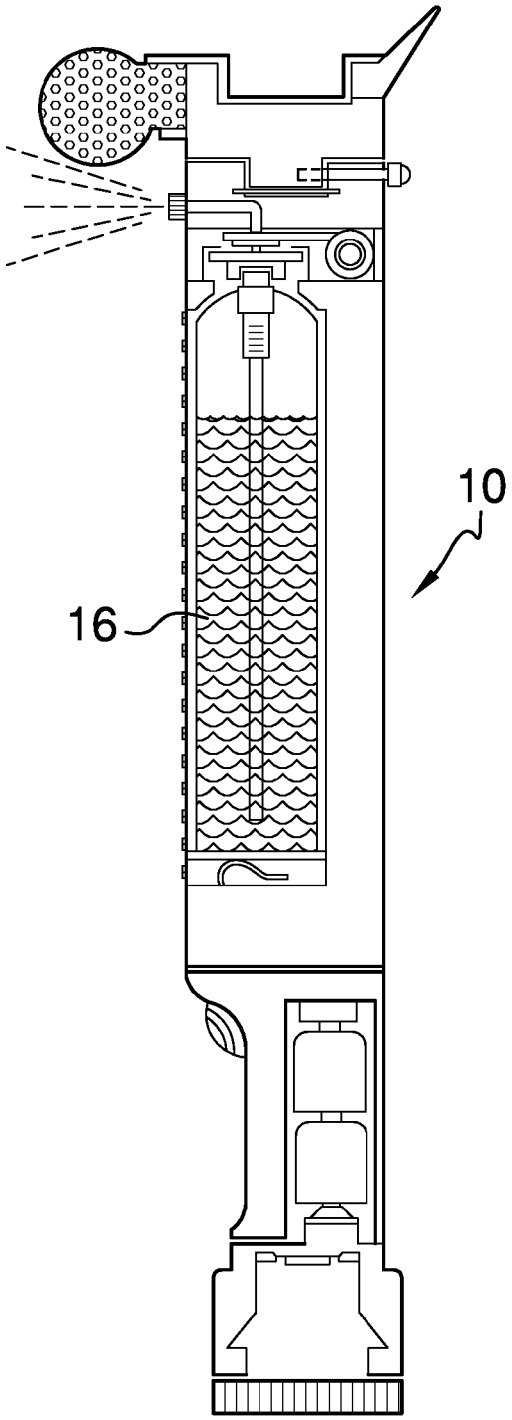
FIG. 5*a* is a diagrammatic partial side cross sectional view of the apparatus of FIG. 1 illustrating the container as a pump container and in use dispensing cleaning fluid from the spray nozzle.

FIG. 5*a* is a diagrammatic partial side cross sectional view of the apparatus 10 of FIG. 1 illustrating the container 16 as a pump container and in use dispensing cleaning fluid from the spray nozzle 21.

Figure 5B:
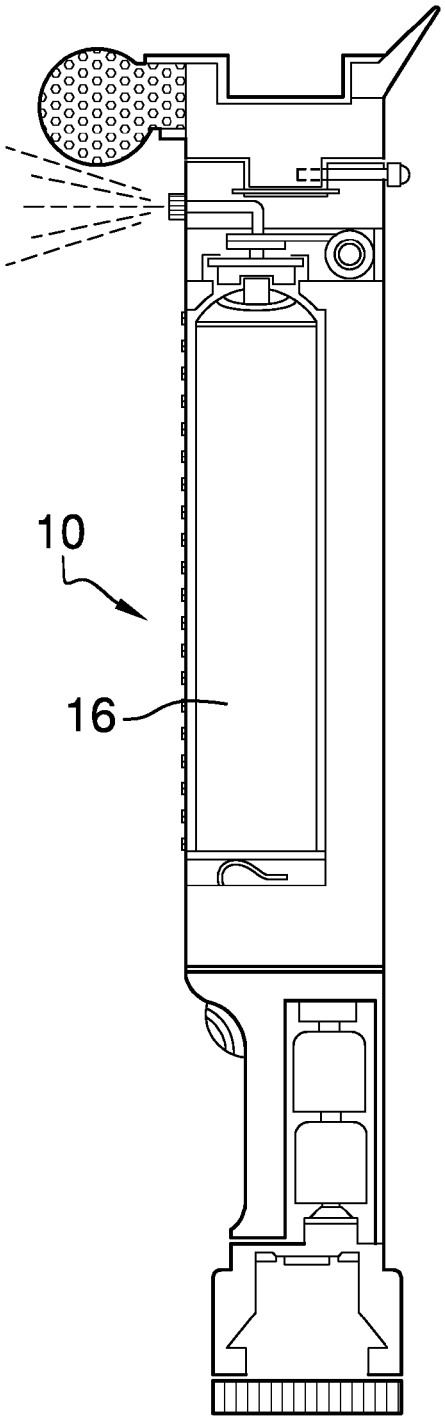
FIG. 5*b* is a diagrammatic partial side cross sectional view of the apparatus of FIG. 1 illustrating the container as an aerosol container and in use dispensing cleaning fluid from the spray nozzle.

FIG. 5*b* is a diagrammatic partial side cross sectional view of the apparatus 10 of FIG. 1 illustrating the container 16 as an aerosol container and in use dispensing cleaning fluid from the spray nozzle 21.

Figure 6A:
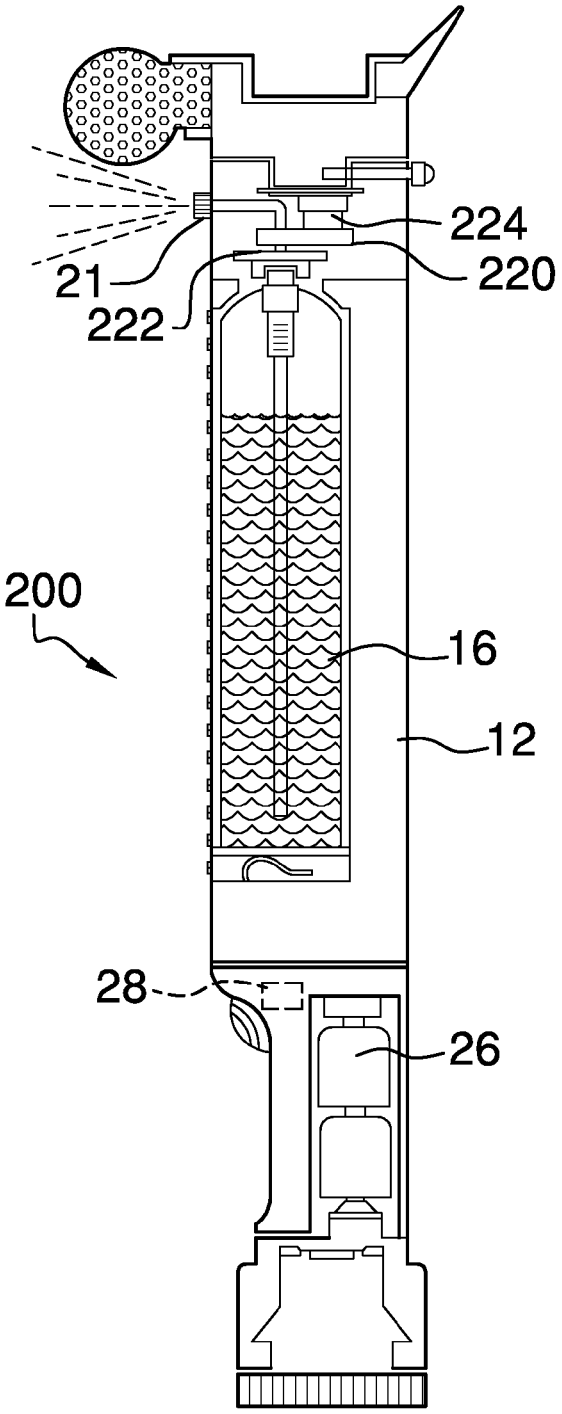
FIG. 6*a* is a diagrammatic partial side cross sectional view of a second embodiment of the apparatus.

Alternative embodiments of the apparatus 10 are possible. FIG. 6*a* is a diagrammatic partial side cross sectional view of a second embodiment of the apparatus 200. The same reference numbers, as employed in the first embodiment, will refer to the same parts, and explanation thereof in detail will be omitted here. In the apparatus 200 the electrical motor 24 of pump 20 of the apparatus 10 is replaced with an alternative pump 220. The pump 220 includes a pump actuator 222 that mechanically drives the pump. There exists numerous suitable configurations of the pump actuator 222 in the art that one of ordinary skill would be readily able to select one of the many available pump actuator configurations for implementation herein. An electric solenoid actuator 224 operatively engages the pump actuator 222 for operation thereof and to dispense the cleaning fluid held within the container 16. The switch 28 electrically connects the solenoid actuator 224 and the power source 26 for selectively supplying power to the solenoid actuator. Further as shown here, the container 16 is depicted as a pump container and with the apparatus 200 in use dispensing the cleaning fluid from the container through spray nozzle 21.

Figure 6B:
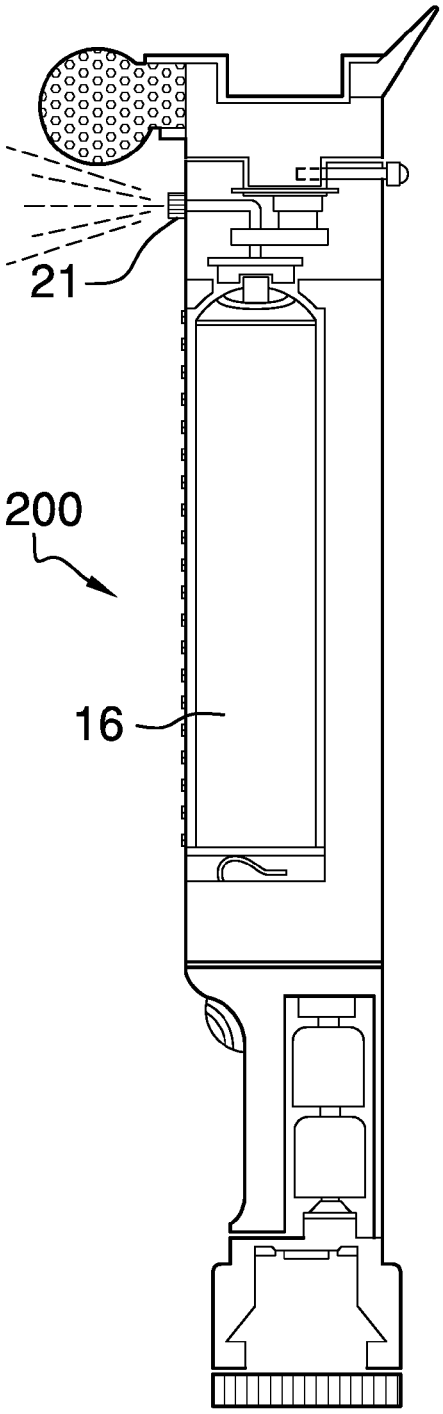
FIG. 6*b* is a diagrammatic partial side cross sectional view of the apparatus of FIG. 6*a* illustrating the container as an aerosol container and in use dispensing cleaning fluid from the spray nozzle.

FIG. 6*b* is a diagrammatic partial side cross sectional view of the apparatus 200 of FIG. 6*a* illustrating the container 16 as an aerosol container and in use dispensing cleaning fluid from the spray nozzle 21.

Figure 7A:
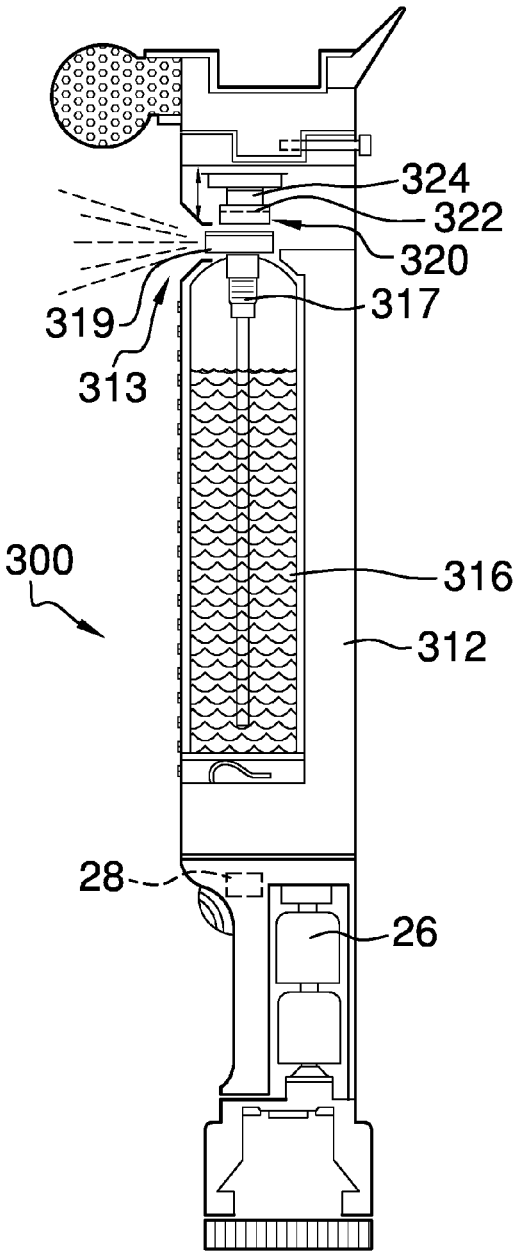
FIG. 7*a* is a diagrammatic partial side cross sectional view of a third embodiment of the apparatus.

FIG. 7*a* is a diagrammatic partial side cross sectional view of a third embodiment of the apparatus 300. The same reference numbers, as employed in the prior embodiments, will refer to the same parts, and explanation thereof in detail will be omitted here. In the apparatus 300 the container 16 and the spray nozzle 20 of the prior embodiments is replaced with a container 316 that includes a spray nozzle 319 integral with a container pump 317. Handle 12 is replaced with handle 312. Handle 312 includes a passage or opening 313 that is positioned for cooperative alignment with the spray nozzle 319 of the container 316 when the container is positioned within the handle 312. Apparatus 300 includes an alternative pump 320 having a pump actuator 322 configured for cooperative engagement with container pump 317 and for mechanically driving the container pump 317. There exists numerous suitable configurations of the pump actuator 322 in the art that one of ordinary skill would be readily able to select one of the many available pump actuator configurations for implementation herein. An electric solenoid actuator 324 operatively engages the pump actuator 322 for operation thereof and to dispense the cleaning fluid held within the container 316. The switch 28 electrically connects the solenoid actuator 324 and the power source 26 for selectively supplying power to the solenoid actuator.

Figure 7B:
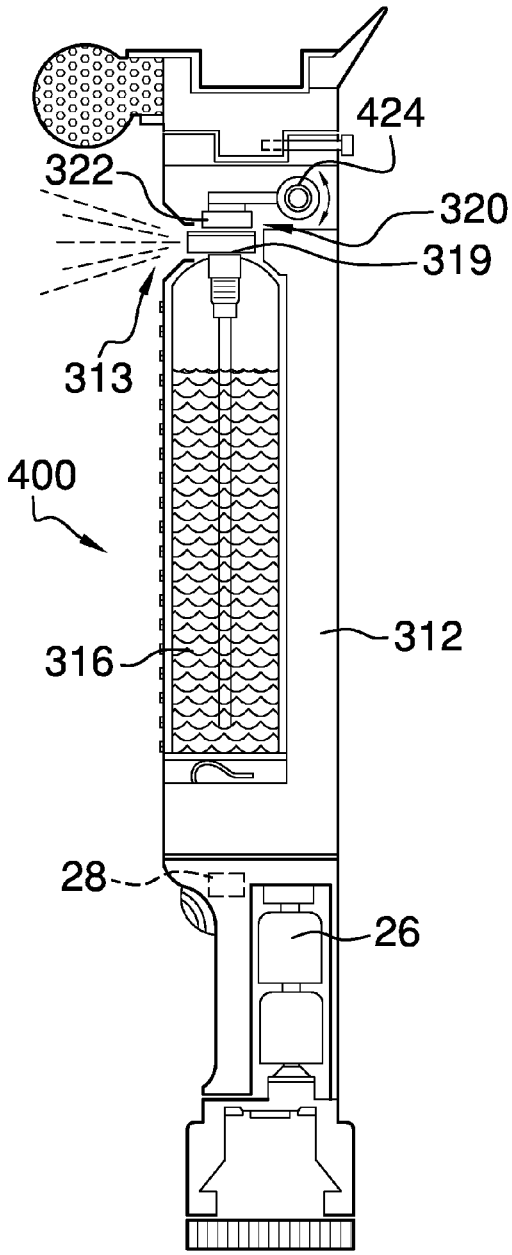
FIG. 7*b* is a diagrammatic partial side cross sectional view of a fourth embodiment of the apparatus.

FIG. 7*b* is a diagrammatic partial side cross sectional view of a fourth embodiment of the apparatus 400. The same reference numbers, as employed in the prior embodiments, will refer to the same parts, and explanation thereof in detail will be omitted here. In the apparatus 400 the solenoid actuator 324 is replaced with an electric motor 424. The switch 28 electrically connects the electric motor 424 and the power source 26 for selectively supplying power to the electric motor.

Figure 8A:
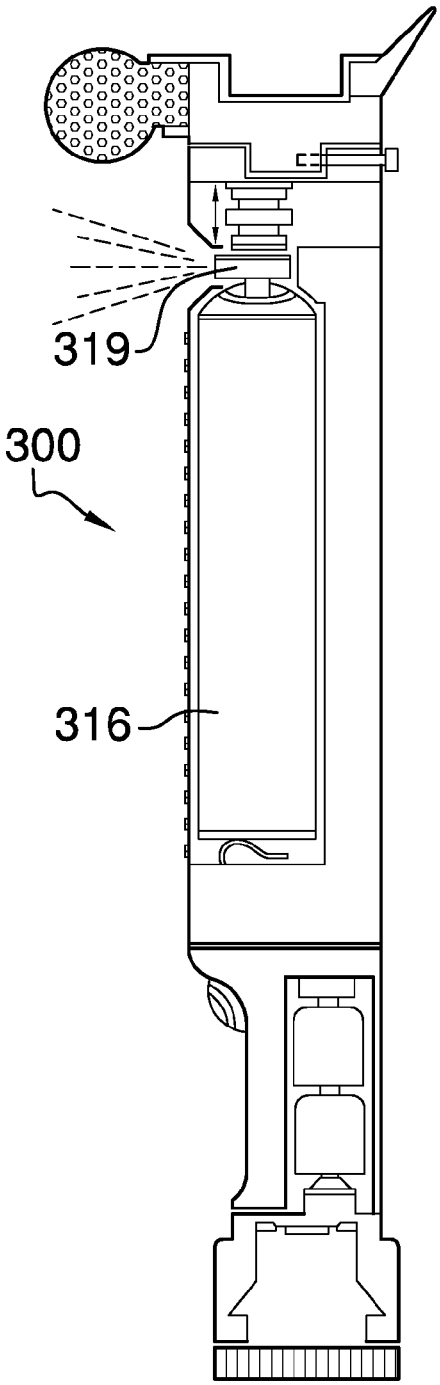
FIG. 8*a* is a diagrammatic partial side cross sectional view of the apparatus of FIG. 7*a* illustrating the container as an aerosol container and in use dispensing cleaning fluid from the spray nozzle.

FIG. 8*a* is a diagrammatic partial side cross sectional view of the apparatus 300 of FIG. 7*a* illustrating the container 316 as an aerosol container and in use dispensing cleaning fluid from the spray nozzle 319.

Figure 8B:
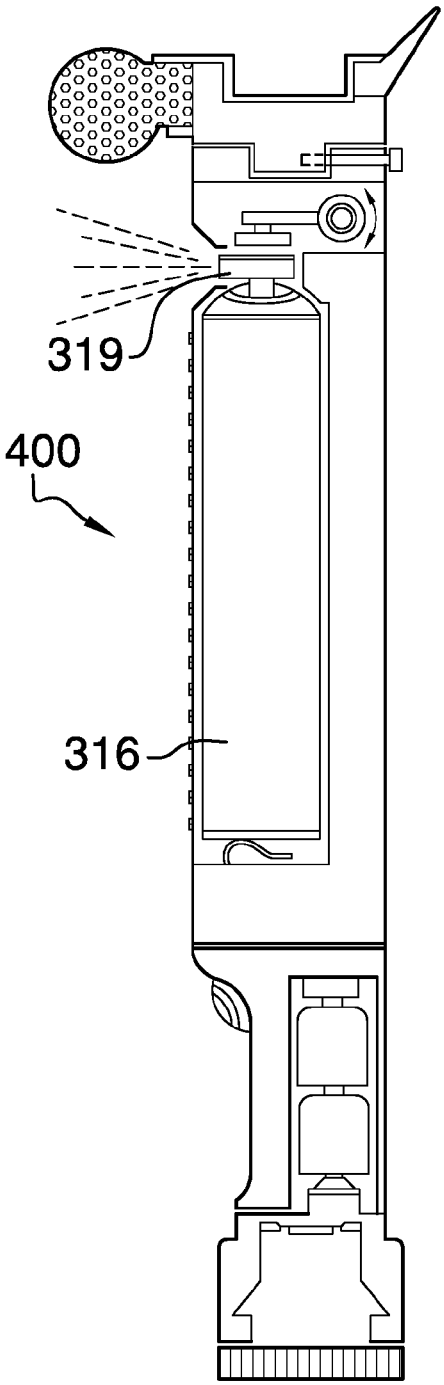
FIG. 8*b* is a diagrammatic partial side cross sectional view of the apparatus of FIG. 7*b* illustrating the container as an aerosol container and in use dispensing cleaning fluid from the spray nozzle.

FIG. 8*b* is a diagrammatic partial side cross sectional view of the apparatus 400 of FIG. 7*b* illustrating the container 316 as an aerosol container and in use dispensing cleaning fluid from the spray nozzle 319.

Figure 9A:
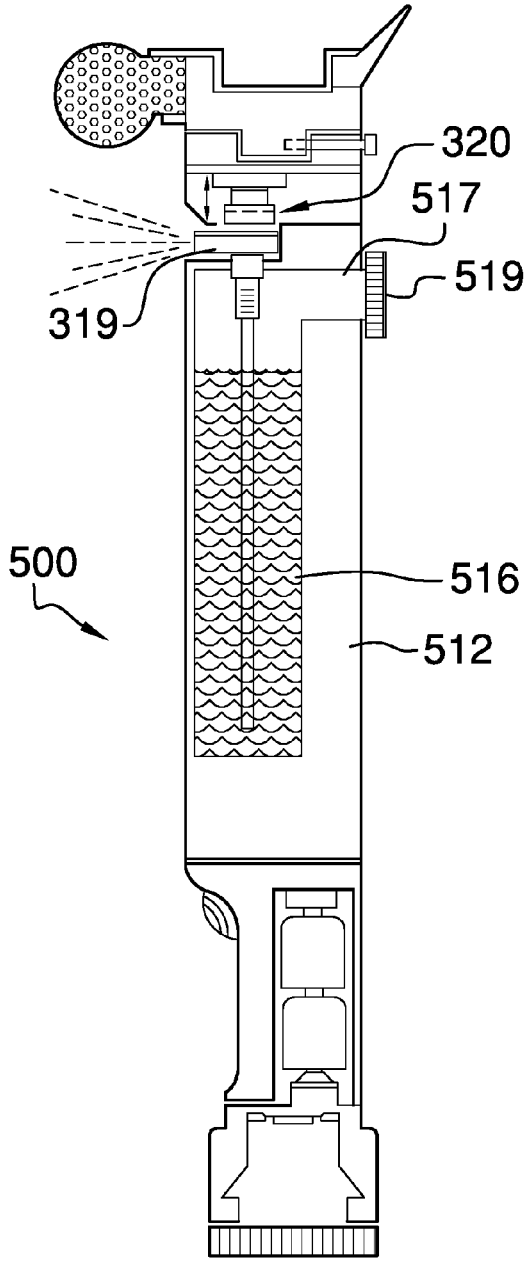
FIG. 9*a* is a diagrammatic partial side cross sectional view of a fifth embodiment of the apparatus.

FIG. 9*a* is a diagrammatic partial side cross sectional view of a fifth embodiment of the apparatus 500. The same reference numbers, as employed in the prior embodiments, will refer to the same parts, and explanation thereof in detail will be omitted here. In the apparatus 500 container 16 is replaced with a container 516 formed integrally with handle 512. Container 516 is not removable from handle 512. Container 516 includes a mouth opening 517 extending through handle 512 and closed by a removable cap 519. Mouth 517 permits filling of container 516 with a cleaning fluid for dispensing. Further depicted is a similar pump and nozzle arrangement of the pump 320 and the nozzle 319 of the third embodiment 300. However, any pump and nozzle arrangement of any of the prior embodiments discussed herein could be implemented in the apparatus 500.

Figure 9B:
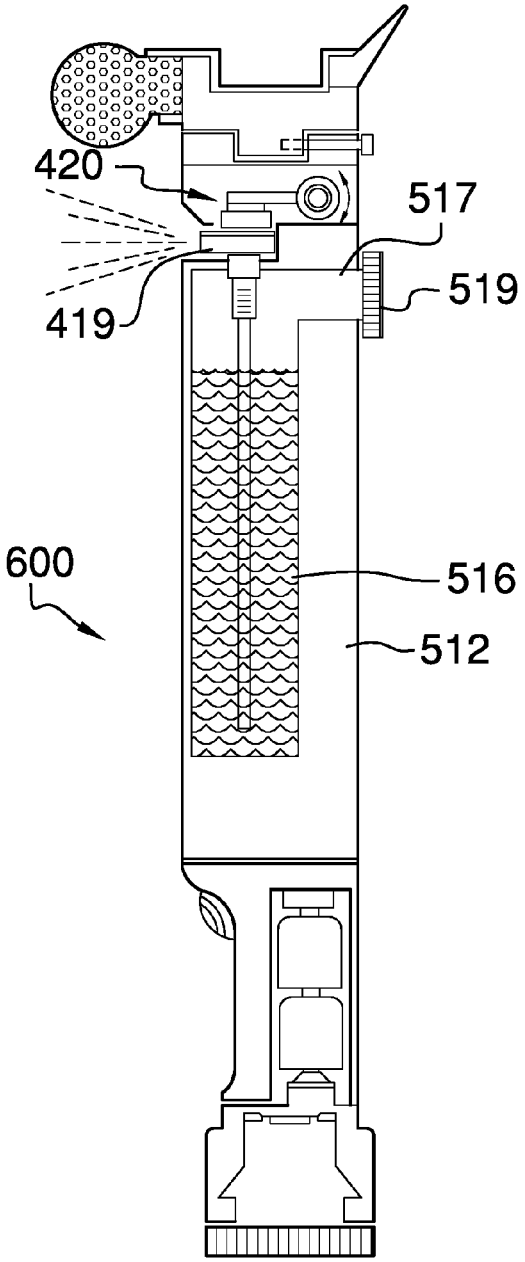
FIG. 9*b* is a diagrammatic partial side cross sectional view of a sixth embodiment of the apparatus.

FIG. 9*b* is a diagrammatic partial side cross sectional view of a sixth embodiment of the apparatus 600. The same reference numbers, as employed in the prior embodiments, will refer to the same parts, and explanation thereof in detail will be omitted here. Apparatus 600 is the apparatus 500 of FIG. 9*a* but with a similar pump and nozzle arrangement of the pump 420 and the nozzle 419 of the fourth embodiment 400. However, any pump and nozzle arrangement of any of the prior embodiments discussed herein could be implemented in the apparatus 600.

Figure 10:
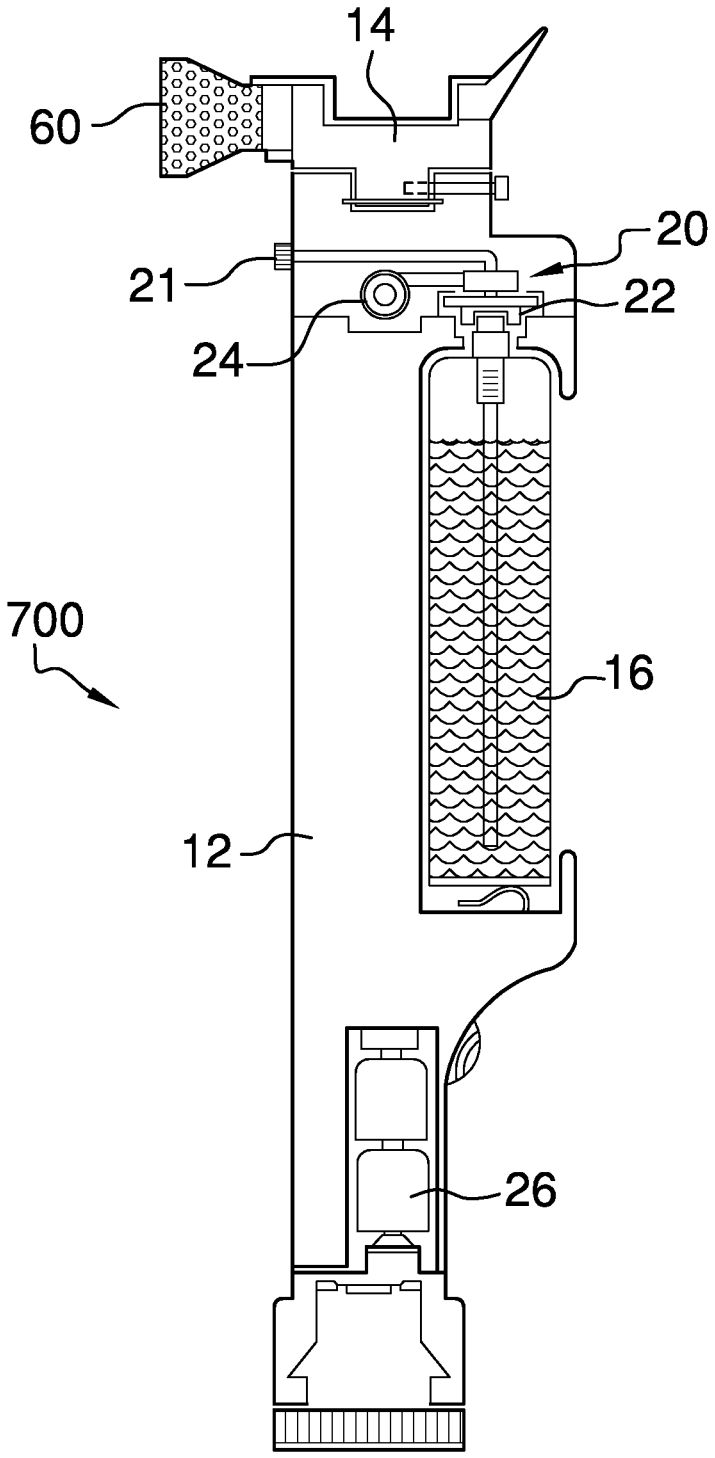
FIG. 10 is a diagrammatic partial side cross sectional view of a seventh embodiment of the apparatus.

FIG. 10 is a diagrammatic partial side cross sectional view of a seventh embodiment of the apparatus 700. The same reference numbers, as employed in the prior embodiments, will refer to the same parts, and explanation thereof in detail will be omitted here.

Figure 11:
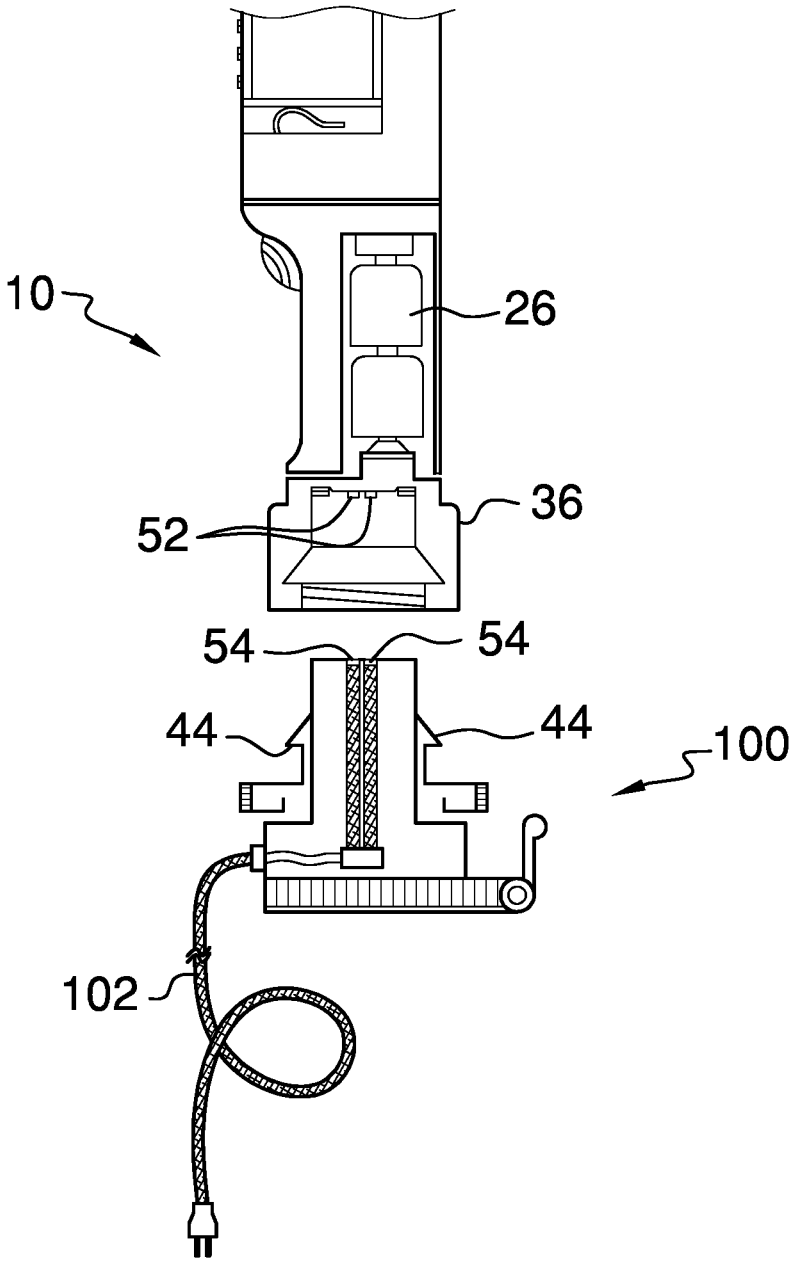
FIG. 11 is a diagrammatic partial side cross sectional view of an additional accessory attachment in the form of a charger for recharging onboard batteries including an electrical cord exploded from the end portion.

FIG. 11 is a diagrammatic partial side cross sectional view of an additional accessory attachment 100 exploded from end portion 36. Accessory attachment 100 includes an electrical outlet cord 102 suitable for plugging into an electrical outlet to provide electrical power to the apparatus 10 as the power source 26 or to charge the batteries. Accessory attachment 100 is attachable to the handle 12 in the same manner as the extension handle 42, as discussed above. To this end, Accessory attachment 100 includes the same cooperative electrical connection including the pair of electrical contacts each including an electrical contact pad 52 positioned within the female receiving space 38 and an electrical contact pad 54 positioned on the extension handle 42. Contact pads 52 and 54 of each electrical contact 50 are arranged such that they are engaged and communicate electrical power when the accessory attachment 100 is connected to the handle 12.

FIG. 12 is a diagrammatic partial front cross sectional view of the apparatus 10 of FIG. 1 illustrating the cleaning head 14 positioned in the in-use position where the cleaning head forms a general T-shape with the handle 12.

FIG. 13 is a diagrammatic partial front cross sectional view of the apparatus 10 of FIG. 1 illustrating the cleaning head 14 positioned in the storage position where the cleaning head is positioned generally parallel to the handle 12.

Figure 14:
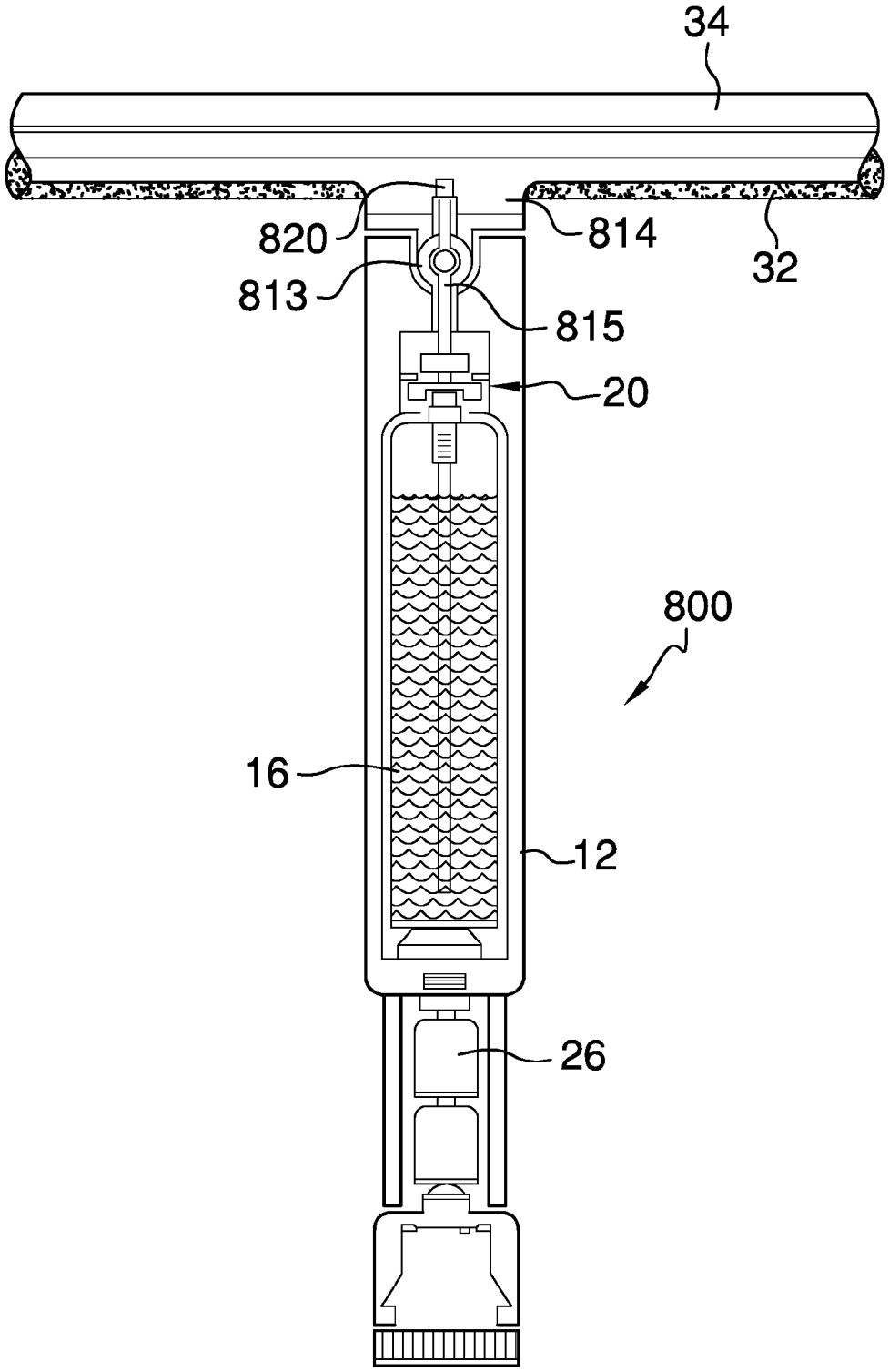
FIG. 14 is a diagrammatic partial front cross sectional view of an eighth embodiment of the apparatus.

FIG. 14 is a diagrammatic partial front cross sectional view of an eighth embodiment of the apparatus 800. The same reference numbers, as employed in the prior embodiments, will refer to the same parts, and explanation thereof in detail will be omitted here. The apparatus 800 replaces spray nozzle 20 with spray nozzle 820 which is positioned on the cleaning head 814 for movement therewith. Pivot coupling 13 is replaced with pivot coupling 813 including a fluid passage way 815 extending therethrough and connecting the spray nozzle 820 with the pump 20 and container 16. The cleaning head 814 is shown in the in-use position.

Figure 15:
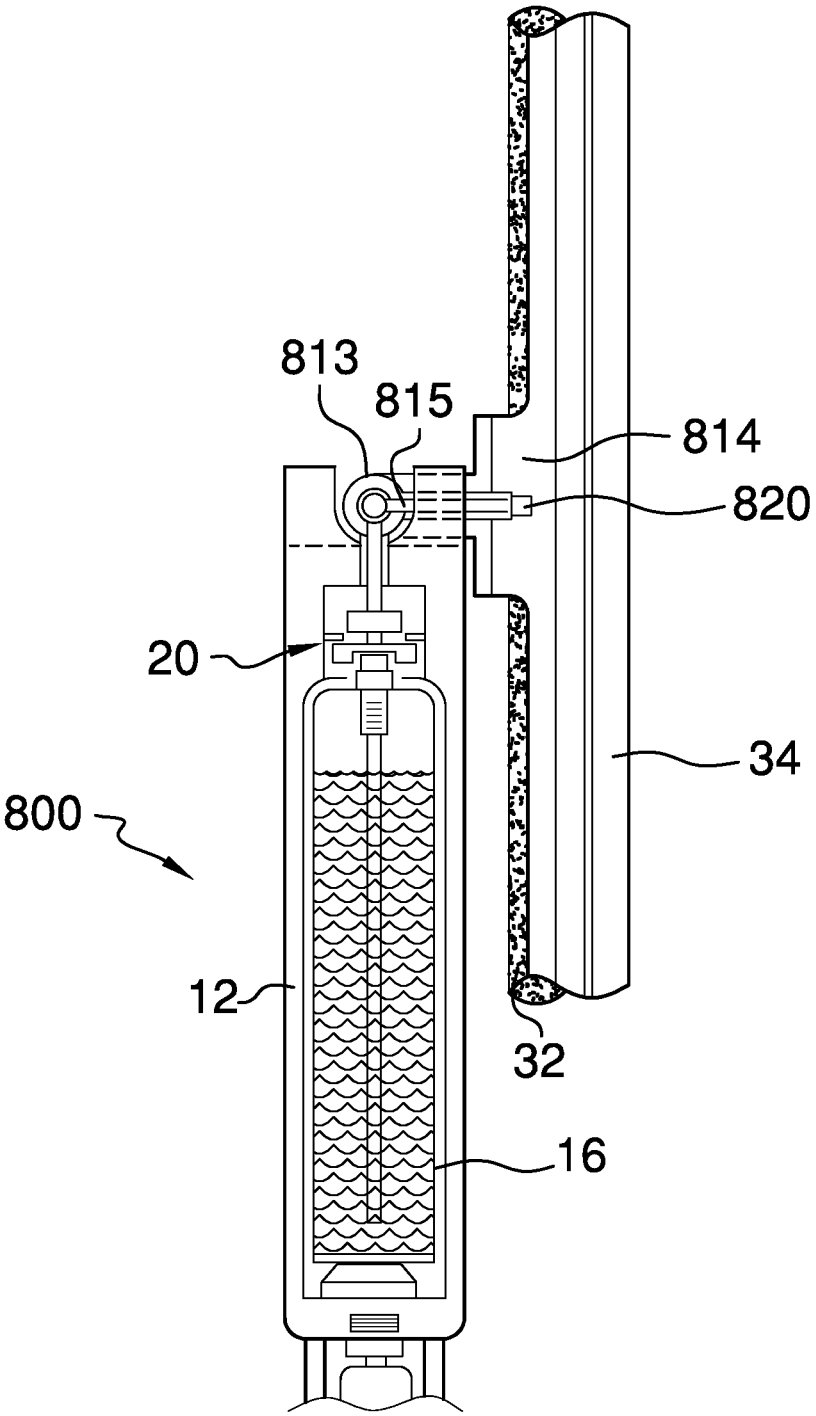
FIG. 15 is diagrammatic partial front cross sectional view of the apparatus of FIG. 14 illustrating the cleaning head in the storage position.

FIG. 15 is diagrammatic partial front cross sectional view of the apparatus 800 of FIG. 14 illustrating the cleaning head 814 in the storage position.

Figure 16:
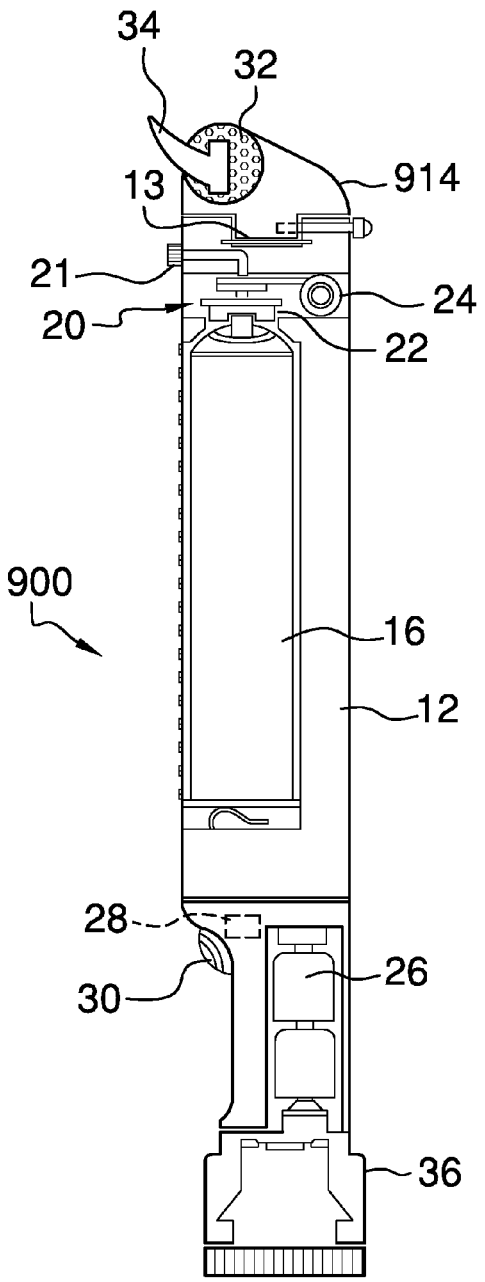
FIG. 16 is a diagrammatic partial side cross sectional view of a ninth embodiment of the apparatus.

FIG. 16 is a diagrammatic partial side cross sectional view of a ninth embodiment of the apparatus 900. The same reference numbers, as employed in the prior embodiments, will refer to the same parts, and explanation thereof in detail will be omitted here. Apparatus 900 includes a cleaning head 914 of an alternative arrangement having an integral cleaning implement 32 and squeegee blade 34 as depicted.

Figure 17:
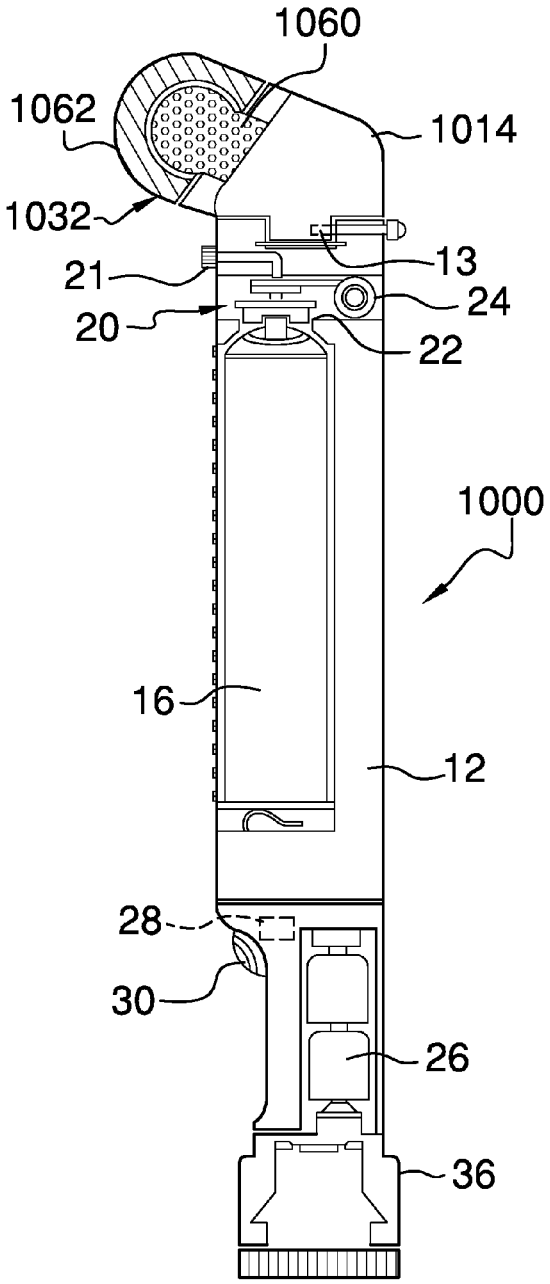
FIG. 17 is a diagrammatic partial side cross sectional view of a tenth embodiment of the apparatus.

FIG. 17 is a diagrammatic partial side cross sectional view of a tenth embodiment of the apparatus 1000. The same reference numbers, as employed in the prior embodiments, will refer to the same parts, and explanation thereof in detail will be omitted here. Apparatus 1000 includes a cleaning head 1014 of yet and additional alternative arrangement having a cleaning implement 1032 and being devoid of a squeegee blade. Cleaning implement 1032 includes a base 1060 of a flexible sponge and a replaceable covering 1062.

Figure 18:
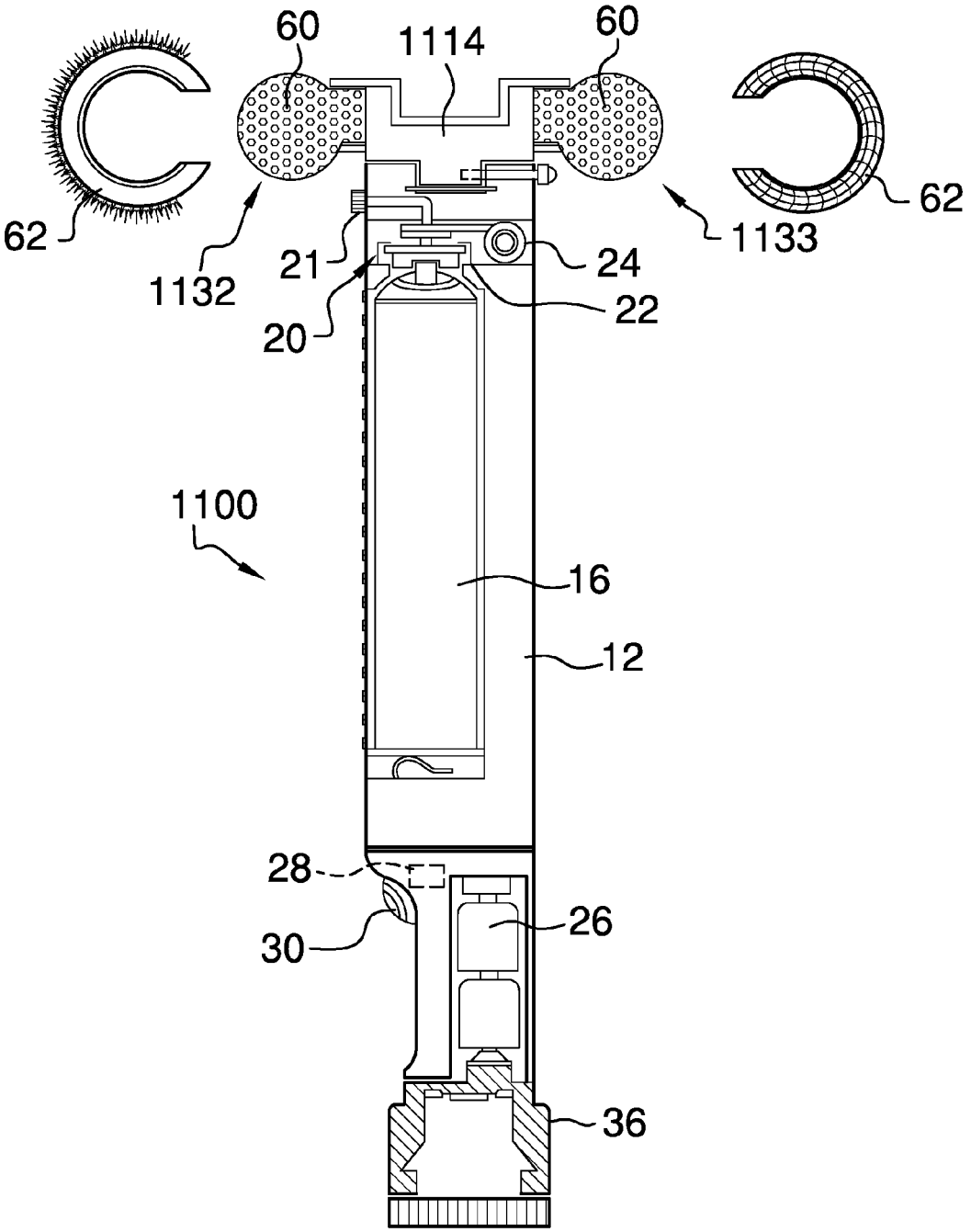
FIG. 18 is a diagrammatic partial side cross sectional view of an eleventh embodiment of the apparatus.

FIG. 18 is a diagrammatic partial side cross sectional view of an eleventh embodiment of the apparatus 1100. The same reference numbers, as employed in the prior embodiments, will refer to the same parts, and explanation thereof in detail will be omitted here. Apparatus 1100 includes a cleaning head 1114 of yet and additional alternative arrangement having a first cleaning implement 1132 and a second cleaning implement 1133. Cleaning implements 1132 and 1133 are positioned on opposite sides of the cleaning head 1114. Each of the cleaning implements 1132 and 1133 are similar to the cleaning implement 32 as discussed and shown above which includes base 60 and replaceable covering 62.

Figure 19:
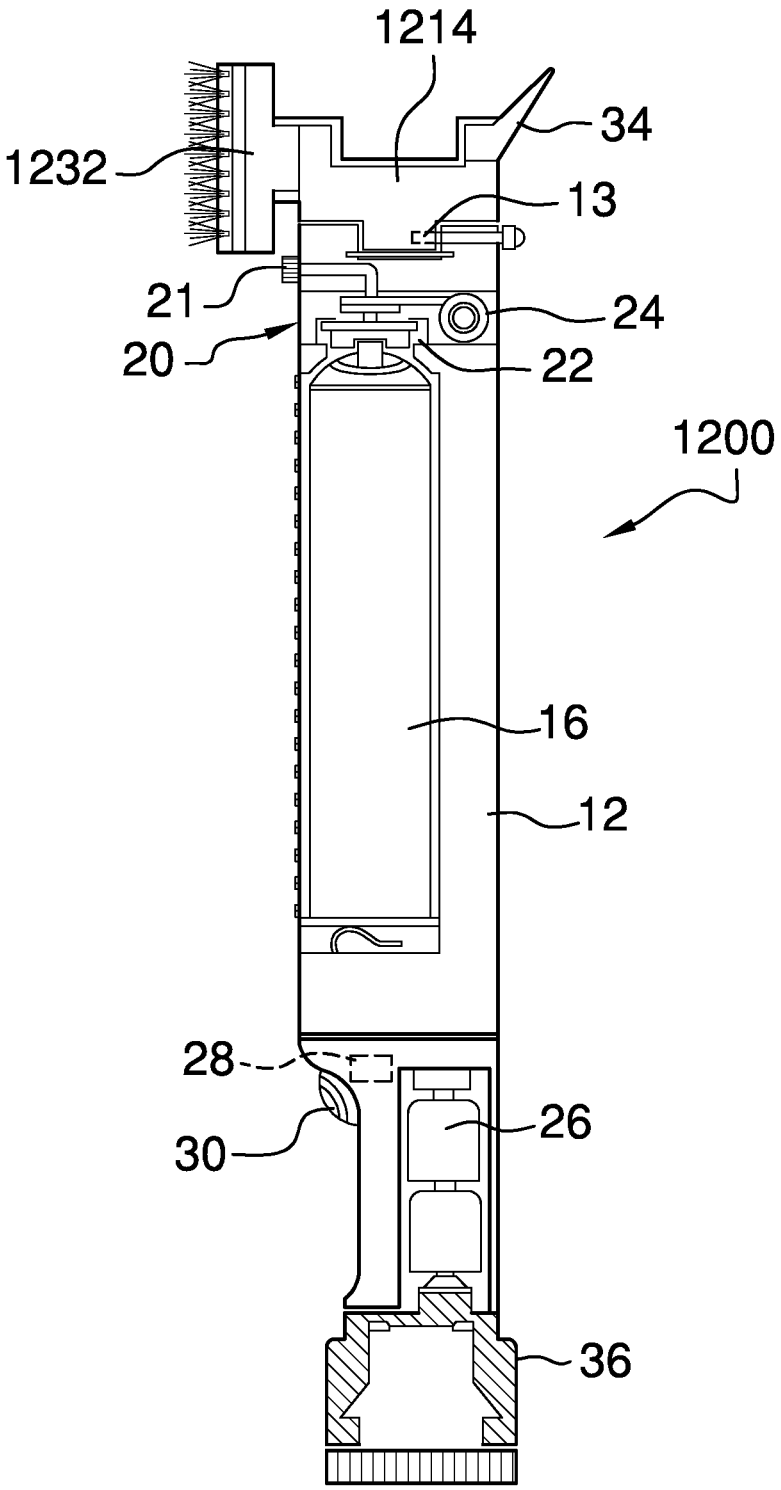
FIG. 19 is a diagrammatic partial side cross sectional view of an twelfth embodiment of the apparatus.

FIG. 19 is a diagrammatic partial side cross sectional view of an twelfth embodiment of the apparatus 1200. The same reference numbers, as employed in the prior embodiments, will refer to the same parts, and explanation thereof in detail will be omitted here. Apparatus 1200 includes a cleaning head 1214 of yet and additional alternative arrangement having including a cleaning implement 1232 in the form of a bristle brush.

Figure 20:
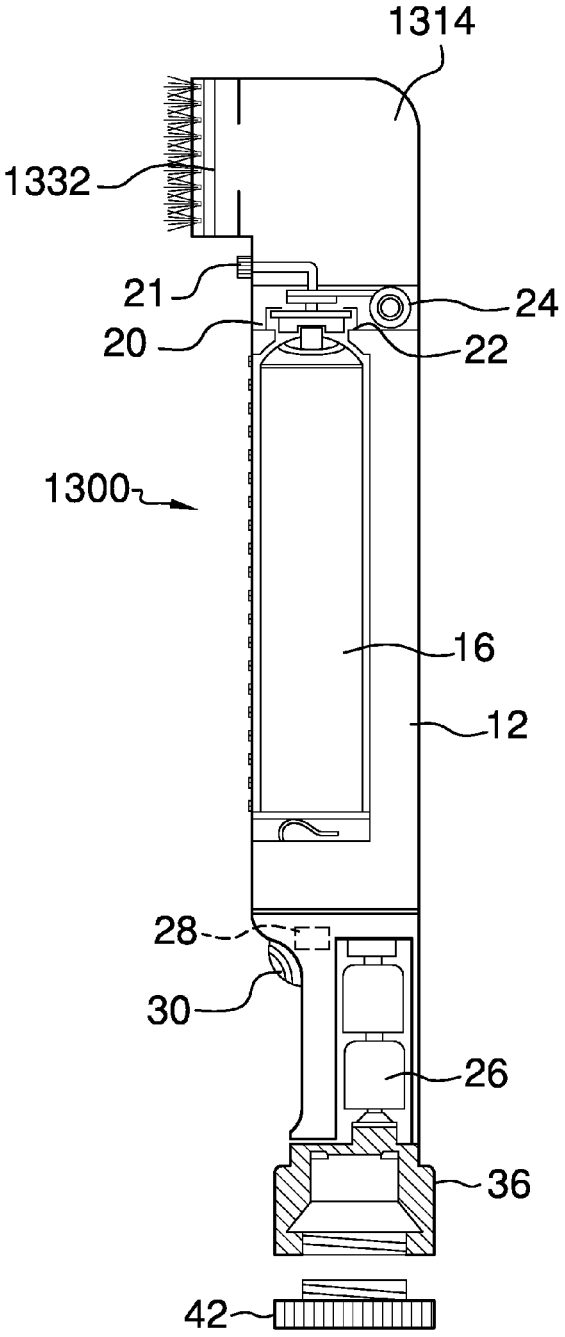
FIG. 20 is a diagrammatic partial side cross sectional view of an thirteenth embodiment of the apparatus.

FIG. 20 is a diagrammatic partial side cross sectional view of an thirteenth embodiment of the apparatus 1300. The same reference numbers, as employed in the prior embodiments, will refer to the same parts, and explanation thereof in detail will be omitted here. Apparatus 1300 includes a cleaning head 1314 of yet and additional alternative arrangement having including a cleaning implement 1332 in the form of a bristle brush and being devoid of a squeegee blade. Here, the cleaning head 1314 is fixed with the handle 1312 and does not pivot or fold.

Figure 21:
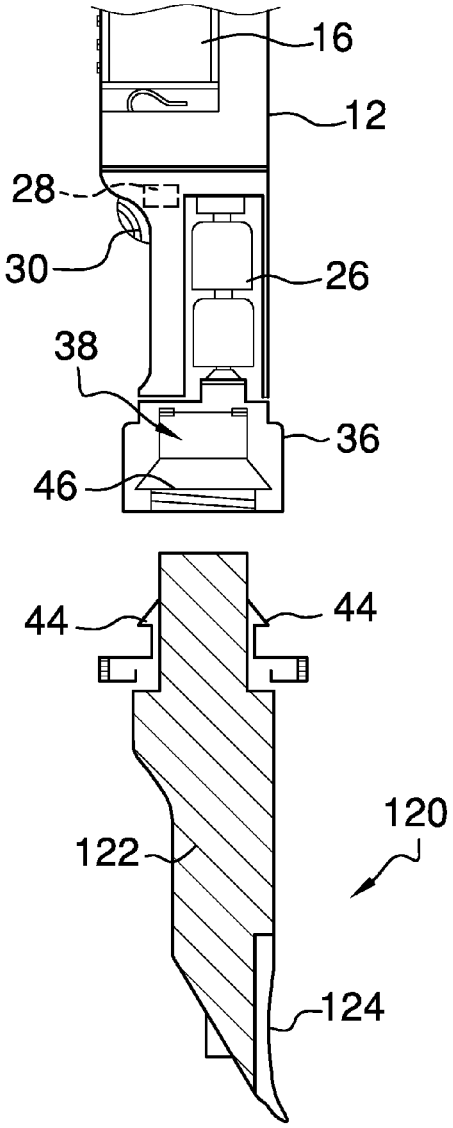
FIG. 21 is a diagrammatic partial side cross sectional view of an additional accessory attachment in the form of a scraper blade exploded from end portion.

FIG. 21 is a diagrammatic partial side cross sectional view of an additional accessory attachment 120 exploded from end portion 36. Accessory attachment 120 is in the form of a scraper blade and includes a body 122 having attached thereto a blade 124 suitable for scraping surfaces. Accessory attachment 120 is attached to handle 12 in the same manner as the prior accessory attachments as discussed and shown above.

Figure 22:
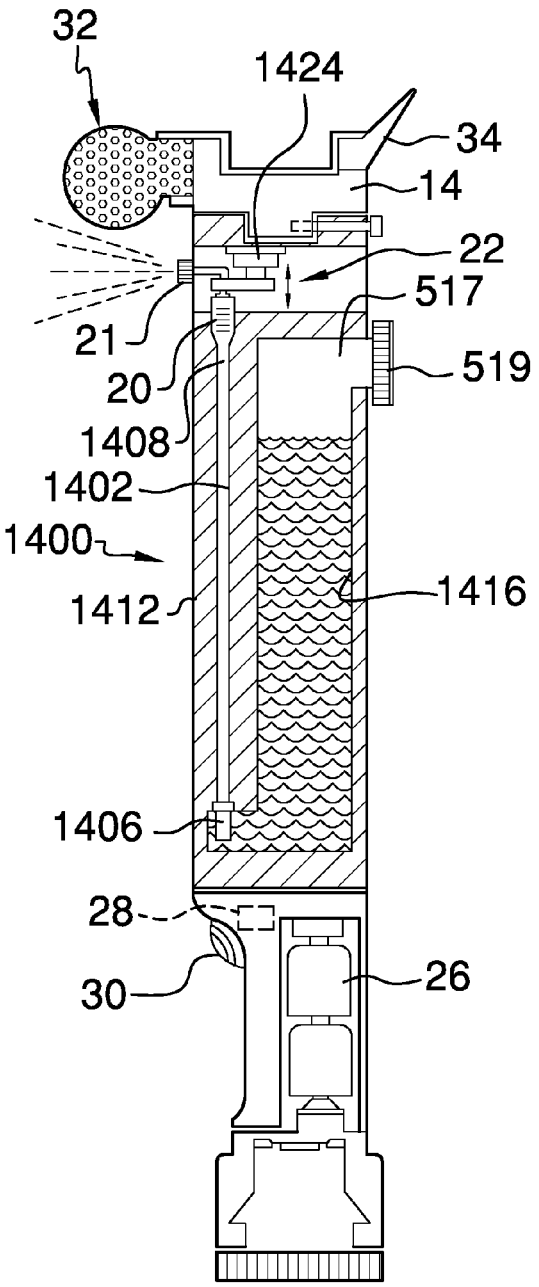
FIG. 22 is a diagrammatic partial side cross sectional view of a fourteenth embodiment of the apparatus.

FIG. 22 is a diagrammatic partial side cross sectional view of an fourteenth embodiment of the apparatus 1400. The same reference numbers, as employed in the prior embodiments, will refer to the same parts, and explanation thereof in detail will be omitted here. The apparatus 1400 is similar to apparatus 500 as discussed above and includes an integral container 1416 formed into handle 1412. A dip tube 1402 extends the length of the handle 1412 exteriorly of the container 1416 and is fluidically connected at end 1406 to container 1416 at the bottom thereof. Opposite end 1408 of the dip tube 1402 includes a pump 1420. The pump 1420 connects the container dip tube 1402 to a spray nozzle 21 through which the cleaning fluid held within the container 1416 is dispensed from during operation of the pump.

The pump 1420 includes a pump actuator 1422 that mechanically drives the pump. A solenoid 1424 operatively engages the pump actuator 1422 for operation thereof to dispense the cleaning fluid held within the container 1416. The solenoid 1424 is electrically connected to a power source, such as batteries 26 held within the handle 1412. A switch 28 electrically connects the solenoid 1424 and the power source 26 for selectively supplying power to the solenoid. A trigger assembly 30 may be included and mounted to the handle 1412. The trigger assembly 30 operatively engages the switch 28 for selective operation thereof.

Figure 23:
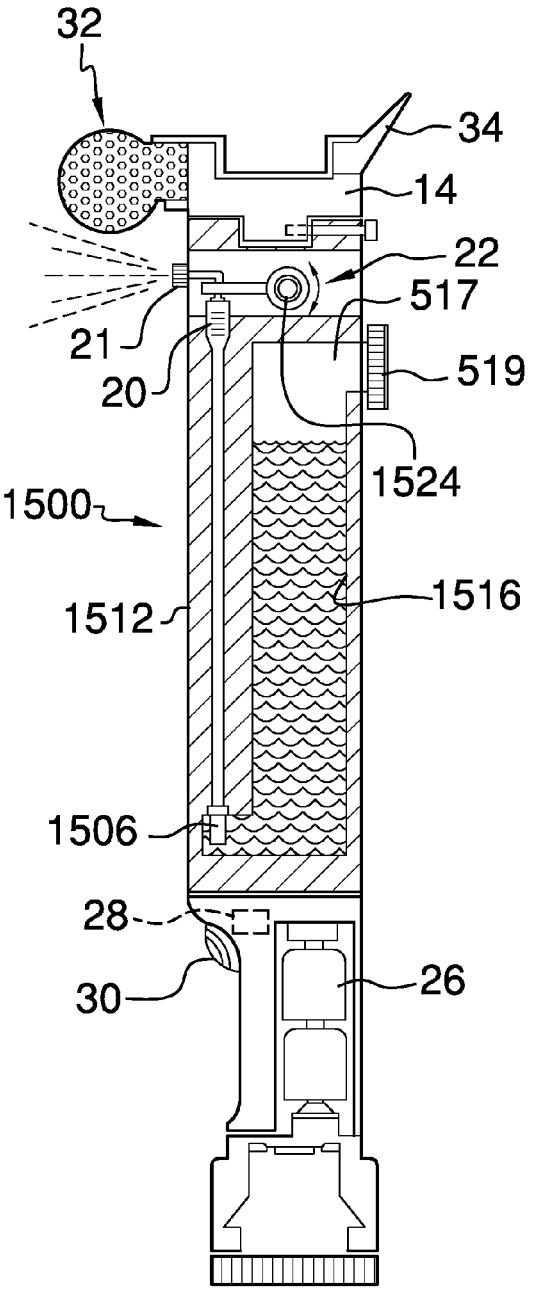
FIG. 23 is a diagrammatic partial side cross sectional view of a fifteenth embodiment of the apparatus.
Figure 24:
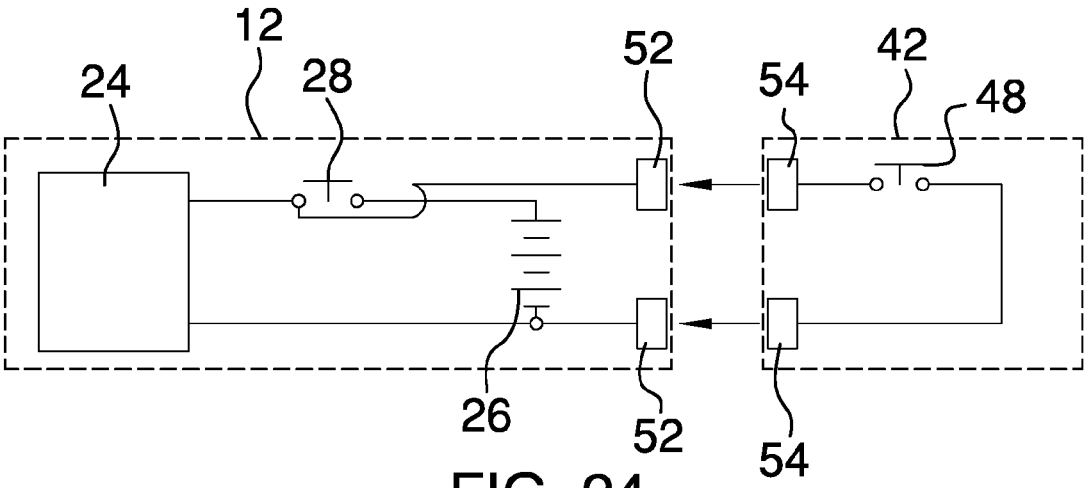
FIG. 24 is an exemplary electric diagram of the apparatus.

FIG. 23 is a diagrammatic partial side cross sectional view of a fifteenth embodiment of the apparatus 1500. The same reference numbers, as employed in the prior embodiments, will refer to the same parts, and explanation thereof in detail will be omitted here. The apparatus 1500 is similar to apparatus 1400 as discussed above and includes an integral container 1516 formed into handle 1512. A dip tube 1502 extends the length of the handle 1512 exteriorly of the container 1516 and is fluidically connected at end 1506 to container 1516 at the bottom thereof. Opposite end 1508 of the dip tube 1502 includes a pump 1520. The pump 1520 connects the container dip tube 1502 to a spray nozzle 21 through which the cleaning fluid held within the container 1516 is dispensed from during operation of the pump.

The pump 1520 includes a pump actuator 1522 that mechanically drives the pump. A motor 1524 operatively engages the pump actuator 1522 for operation thereof to dispense the cleaning fluid held within the container 1516. The motor 1524 is electrically connected to a power source, such as batteries 26 held within the handle 1512. A switch 28 electrically connects the motor 1524 and the power source 26 for selectively supplying power to the motor 1524. A trigger assembly 30 may be included and mounted to the handle 1512. The trigger assembly 30 operatively engages the switch 28 for selective operation thereof.

A number of embodiments of the present invention have been described. Nevertheless, it will be understood that various modifications may be made without departing from the spirit and scope of the invention.

What is claimed is:

1. A glass and window cleaning apparatus, comprising:

a cleaning head;

an elongated handle configured to be grasped by a user, said handle having a first end connected to said cleaning head and a second end configured to be connected to an extension handle;

a fluid container housed by said handle;

a spray nozzle carried by said handle at a position approximate said first end of said handle;

a pump carried by said handle, said pump connecting said fluid container to said spray nozzle, said pump including a pump actuator;

an electric motor carried by said handle and operatively connected to said pump actuator to drive said pump actuator in the pumping of fluid from said container through said spray nozzle;

a power source carried by said handle;

an electric switch carried by said handle and operatively connected to said power source and said electric motor, said switch operable by the user to connected said power source to said electric motor to facilitate the pumping of said fluid through said spray nozzle;

an extension handle connected to said handle at said second end thereof; and a secondary electric switch carried by said extension handle and operatively connected to said power source and said electric motor, said secondary switch operable by the user to connected said power source to said electric motor to facilitate the pumping of said fluid through said spray nozzle.

2. The apparatus of claim 1, wherein said cleaning head includes a cleaning implement and a squeegee blade positioned on opposite sides of said cleaning head.

3. The apparatus of claim 1, wherein said cleaning head is pivotally connected to said first end of said handle.

4. The apparatus of claim 1, wherein said container is removable received by said handle.

5. The apparatus of claim 1, wherein said container is integral with said handle.

6. The apparatus of claim 1, wherein said second end of said handle includes a female receiving space and wherein said extension handle and said female receiving space are configured for cooperative engagement such that said extension handle is fixedly connected to said handle.

7. The apparatus of claim 6, wherein said cleaning head includes a cleaning implement and a squeegee blade positioned on opposite sides of said cleaning head.

8. The apparatus of claim 6, wherein said cleaning head is pivotally connected to said first end of said handle.

9. The apparatus of claim 6, wherein said container is removable received by said handle.

10. The apparatus of claim 1, wherein said electric motor is a solenoid.

11. The apparatus of claim 10, wherein said second end of said handle includes a female receiving space and wherein said extension handle and said female receiving space are configured for cooperative engagement such that said extension handle is fixedly connected to said handle.

12. The apparatus of claim 10, wherein said cleaning head includes a cleaning implement and a squeegee blade positioned on opposite sides of said cleaning head.

13. The apparatus of claim 10, wherein said cleaning head is pivotally connected to said first end of said handle.

14. The apparatus of claim 10, wherein said container is removable received by said handle.

* * * * *